US012071732B2

(12) United States Patent
Machado et al.

(10) Patent No.: US 12,071,732 B2
(45) Date of Patent: Aug. 27, 2024

(54) RAILWAY SLEEPERS AND METHODS THEREOF

(71) Applicant: Braskem S.A., Camaçari (BR)

(72) Inventors: Aldo Marconi Wessen Machado, São Paulo (BR); Jesus Waldemar Golçalves da Silva, São Paulo (BR); Renato Teixeira Vargas, São Paulo (BR); Walter Vidon Junior, São Paulo (BR)

(73) Assignee: Braskem S.A., Camaçari (BR)

( * ) Notice: Subject to any disclaimer, the term of this patent is extended or adjusted under 35 U.S.C. 154(b) by 503 days.

(21) Appl. No.: 16/883,699

(22) Filed: May 26, 2020

(65) Prior Publication Data

US 2020/0370247 A1 Nov. 26, 2020

Related U.S. Application Data

(60) Provisional application No. 62/852,873, filed on May 24, 2019.

(51) Int. Cl.
*E01B 3/44* (2006.01)

(52) U.S. Cl.
CPC ..... *E01B 3/44* (2013.01)

(58) Field of Classification Search
CPC ..... E01B 3/46; E01B 3/44; E01B 3/36; E01B 9/681; E01B 9/685; E01B 3/10; E01B 9/683; E01B 3/30
USPC ..... 238/84, 85, 83
See application file for complete search history.

(56) References Cited

U.S. PATENT DOCUMENTS 5,855,334 A * 1/1999 Abe ..... G03B 27/588 242/348
5,960,592 A * 10/1999 Lilienthal, II ..... E04H 1/1238 52/79.5
2003/0205626 A1* 11/2003 Hansen ..... C08L 19/003 238/83
2007/0012794 A1* 1/2007 Ollendick ..... E01B 3/46 238/83
2007/0187522 A1* 8/2007 Kirchmer ..... B29C 45/73 238/84

(Continued)

FOREIGN PATENT DOCUMENTS

CA 2966917 A1 * 5/2016 ..... B29C 48/00
DE 102017207746 A1 11/2018

(Continued)

OTHER PUBLICATIONS

International Search Report issued in corresponding International Application No. PCT/IB2020/020027; dated Jul. 13, 2020 (5 pages).

(Continued)

*Primary Examiner* — Zachary L Kuhfuss
(74) *Attorney, Agent, or Firm* — Osha Bergman Watanabe & Burton LLP

(57) ABSTRACT

A railroad sleeper for fixation of at least one pair of rails of a railroad network, the railroad sleeper may include a contact surface, wherein each rail of the pair of rails is fixed thereto spaced apart from each other; anchorage walls extending downward from the contact surface, and having a support point at a bottom surface thereof, the anchorage walls having at least one aperture formed therein; and a void delimited by the contact surface and anchorage walls.

19 Claims, 25 Drawing Sheets

(56) References Cited

U.S. PATENT DOCUMENTS

| | | | | |
|---|---|---|---|---|
| 2009/0260305 | A1* | 10/2009 | Haub | B60P 1/286<br>52/592.1 |
| 2011/0155820 | A1* | 6/2011 | Djerf | E01B 3/46<br>29/458 |
| 2018/0327977 | A1 | 11/2018 | Nose et al. | |

FOREIGN PATENT DOCUMENTS

| | | | | |
|---|---|---|---|---|
| JP | 2008050912 | A | 3/2008 | |
| JP | 2008057102 | A | 3/2008 | |
| WO | WO-2006116405 | A2 * | 11/2006 | E01B 3/44 |
| WO | WO-2015043689 | A1 * | 4/2015 | E01B 3/46 |

OTHER PUBLICATIONS

Written Opinion of the International Searching Authority issued in corresponding International Application No. PCT/IB2020/020027; dated Jul. 13, 2020 (7 pages).

* cited by examiner

FIG. 20A
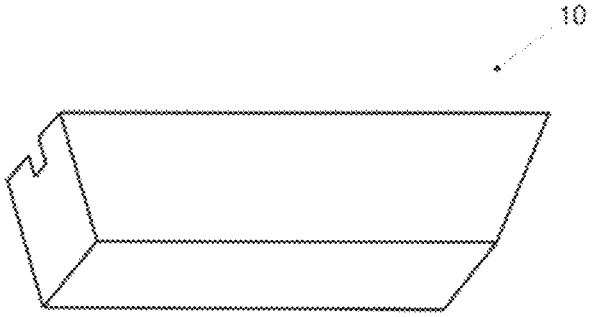
FIG. 20 (a)
FIG. 20B
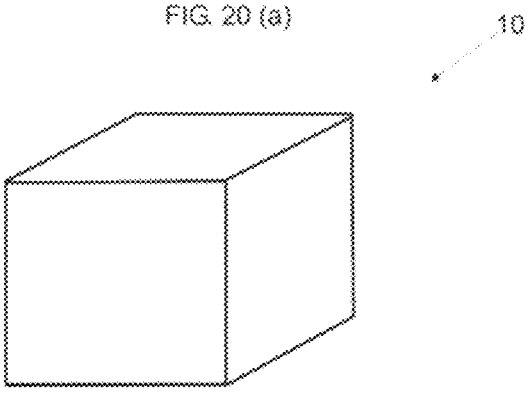
FIG. 20 (b)
FIG. 20C
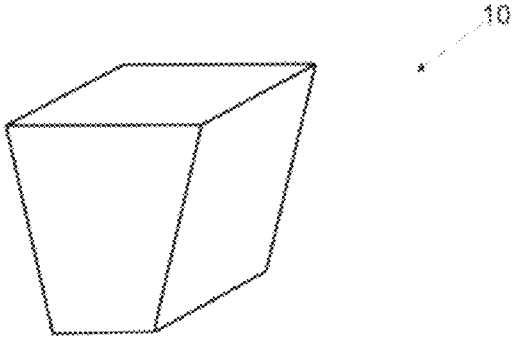
FIG. 20 (c)
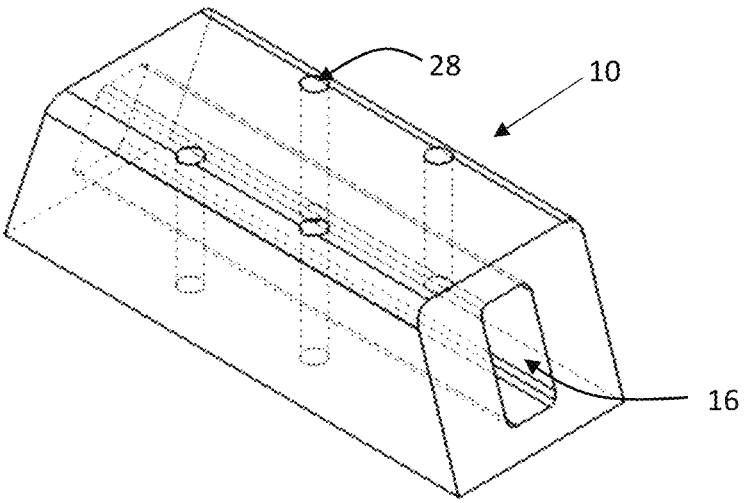
FIG. 20D

RAILWAY SLEEPERS AND METHODS THEREOF

BACKGROUND

Railroader sleepers represent one of the various components of a railroad network and, in conjunction with the ballast and other fastening elements, promote correct anchorage (fixation) of the rails on which the coaches travel. Conventionally, the great majority of the elements are made of wood (about 90%), the rest being steel, concrete or recycled-plastic sleepers.

A wooden sleeper has a useful life estimated to be a few decades; after this period, it is necessary to replace it. It is estimated that over 30 million wooden sleepers are replaced each year in the world, and there are the legal restrictions relating to the use of determined types of raw materials, causing the sector to look for alternatives to wooden sleepers. Generally, alternatives have concentrated on sleepers made of wood, steel, concrete, reforestation-wood, plastic (be it recycled or virgin).

The use of sleepers made of virgin plastic have exhibited good behavior. However, the use of this type of sleeper is restricted to passenger-transportation railroads, of narrow gauge, subject to efforts other than those resulting from a load system.

Recycled plastic sleepers were used in a few railroad networks and showed structural problems, such as endemic dissemination of cracks, warping and fixation problems. In particular, with a recycled sleeper it becomes difficult to obtain homogeneity in the material forming the sleeper.

Concrete sleepers, in spite of being widespread in railroad networks around the world, have not proved to be the best solution for the characteristics of the railroad beds and ballasts of the lines existing in some countries (such as Brazil and the United States), due to the great inertia and rigidity of the commercial models that are most commonly available. This tends to cause high breakage of ballasts, which increases the railroad-maintenance costs and enables the occurrence of accidents. Furthermore, installation of concrete sleepers in countries with high humidity weather is difficult due to the material's inherent water absorption characteristics.

Classified according to their shape, concrete sleepers may be of the mono-block type, formed by a single rigid and continuous piece, and are subjected to great bending moments, which appear at different sections of the sleeper. There are also concrete sleepers of the bi-block type (mixed sleepers), composed of two rigid blocks of reinforced concrete arranged under each rail and joined by a flexible steel bar. Due to the elasticity of the beam, the two blocks of concrete will be immune to most stresses of static bending and alternating bending, which sleepers made of prestressed concrete hardly resist.

Among concrete sleepers, there are also bi-block sleepers, wherein two reinforced-concrete blocks are arranged at the ends in conjunction of an intermediate piece, also made from concrete. The blocks of the sides, as well as the intermediate one, are joined by steel means of rods having high elastic limit, stressed and anchored at the ends.

On the other hand, the use of concrete sleepers presents a few disadvantages, such as higher transportation cost, due to the greater weight of this sleeper as compared with wood ones, as well as the questionable re-use of the sleeper after the occurrence of derailment. Additionally, using concrete sleepers, the fastening systems are not adjustable to the rail wear and to the widening of the railroad. Further, there is the need for expensive equipment for installing and maintaining the railroads, and in some situations, damage may be caused to the ballast due to the great weight of the sleeper.

As already mentioned, in addition to concrete and plastic sleepers, some sleepers are also made of steel. Steel sleepers exhibit satisfactory behavior when in use. However, they may have high and uncertain costs, since their cost depends directly on the price of the steel, which is extremely instable. Further, the fastening of this type of sleeper is usually made by means of screws and chestnuts and needs permanent maintenance. Further, the fastening by means of screw ends up weakening the sleeper due to the bores made therein.

Advantages of steel sleepers include the possibility of recycling, long useful life (about 60 years), being inert and non-toxic, low installation cost, simple transportation, and it is non-combustible by virtue of its manufacture material. Its disadvantages include that the use of steel sleepers requires a greater number of interventions and change in the tamping area. Further, this type of sleeper may entail the interruption of the trip, due to the isolation jeopardy and still may undergo corrosion problems.

With regard to wooden sleepers, these should be previously treated (chemically) in order to be suitable for use. Such a chemical treatment is harmful to the environment. Chemical treatment stations are responsible for storing the sleepers and for applying preservatives, with a view to prolong the useful life of the sleeper and preventing the proliferation of fungi and insects. In addition to being a long process comprising a number of steps, the process of treating sleepers may cause various environmental problems, such as air pollution, due to the breaking of storage tanks, treatment cylinders and tubing that contain the preserving agents. Additionally, it is not rare that employees may accidentally absorb, inhale, and ingest chemical products. Further, the use of herbicides and pesticides may contaminate the soil and the streams, causing changes in the behavior of the fauna and the possibility of extinction of species.

It is further possible to use sleepers made from reforestation wood, this type of sleeper exhibiting resistance significantly lower than that of hard wood. Additionally, the impossibility (in some countries) of treating sleepers with some products (such as creosote) that are strongly aggressive to the environment enables the sleeper to be attached by biological agents, such as bacteria and white ants, resulting in an extremely short life time (on the order of three to four years), which is much shorter than the useful life of sleepers made from hard wood.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a railroad sleeper for fixation of at least one pair of rails of a railroad network, where the railroad sleeper includes a contact surface, wherein each rail of the pair of rails is fixed thereto and spaced apart from each other; anchorage walls extending downward from the contact surface and having a support point at a bottom surface thereof, the anchorage walls having at least one aperture formed therein; and a void delimited by the contact surface and anchorage walls.

In another aspect, embodiments disclosed herein relate to a fastening block for use with a railroad sleeper to fix at least one pair of rails of a railroad network, where the fastening block includes at least one aperture or void spaced formed therein.

In yet another aspect, embodiments disclosed herein relate to a railroad structure assembly that includes a railroad sleeper for fixation of at least one pair of rails of a railroad network, the railroad sleeper comprising: a contact surface, wherein each rail of the pair of rails is fixed to the contact surface and spaced apart from each other; anchorage walls extending downward from the contact surface; and a void space delimited by the contact surface and anchorage walls; and at least one fastening block present within the void space at a portion of the railroad sleeper corresponding to a location of a rail, wherein at least one of the anchorage walls or the at least one fastening block as apertures formed therein or the at least one fastening block has a void space formed therein.

Other aspects and advantages of the claimed subject matter will be apparent from the following description and the appended claims.

BRIEF DESCRIPTION OF DRAWINGS

FIGS. 20A-F illustrate structural embodiments for the fastening blocks;

DETAILED DESCRIPTION

Figure 1A:
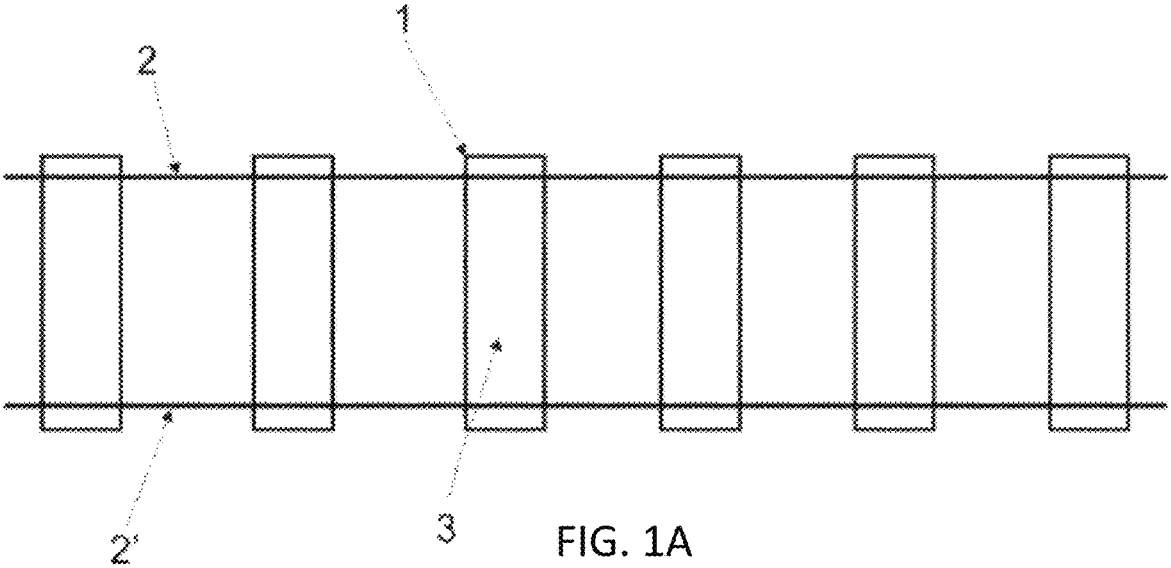
FIG. 1A is a top representation of a simple railroad network suitable for receiving the railroad structures of the present disclosure.

In one aspect, embodiments disclosed herein relate to components of a railroad network, specifically railway sleepers (also referred to in some locations as a railroad tie or crosstie) and fastening blocks that may, in conjunction with the ballast and other fixing elements, promote correct anchorage (fixation) of the rails on which the coaches travel. Railway sleepers are the rectangular supports for the rails in railroad tracks, which are generally laid perpendicular to the rails. They serve to transfer loads to the track ballast and subgrade, hold the rails upright and keep them spaced to the correct gauge. As discussed above, there are concerns with different types of materials conventionally used in railway sleepers, some of which limit the useful life of the sleepers and others of which limit the types of railroad lines in which the materials may be used. Embodiments disclosed herein relate to the use of a railway components that may be used on railroad lines in both construction and operation, for transporting loads and/or passengers.

Plastic composite-engineered sleepers (either virgin or recycled) known from the prior art do not exhibit optimized combinations between weight of the piece and elasticity modulus. Most known plastic proposals for sleeper exactly imitate the shape of a wooden sleeper, making the piece heavier and consuming not only more raw material, but also significant man-hours and machine-hours to make the pieces. Such factors make the production process slow and increase the final price of the sleepers.

However, embodiments disclosed herein are directed to a railroad sleeper, made of a polyolefin material, such as for example polypropylene with fiberglass, manufactured from a high-productivity process, preferably extrusion, and further having a structural shape that enables one to achieve rigidity close to those of the hard-wood sleepers, as well as competitive costs. Embodiments disclosed herein are also directed to a process for manufacturing a railroad sleeper by an extrusion process that enables compaction of the composition used in making the sleeper within the calibrator of the extruding machine, as well as homogeneous cooling of the whole thickness of the sleeper that is being produced.

Advantageously, the sleeper of the present disclosure may have a reduced final price, which facilitates transportation and installation of the piece. The presently described sleepers also enable the use of standard fixing devices used on wooden sleepers, use standard machines employed for installation and maintenance of sleepers and, due to their manufacture material, enable one to recycle the product at the end of the useful life of the sleeper.

Structurally, the proposed railroad sleeper forms an inverted U shape (bored-through sector), which acts as an important differential for the function and characteristic of anchoring on the ballast. Due to its proposed shape, the ballast used on the railroad will penetrate the sleeper, thus becoming an integral body. Further, with the compaction of the ballast inside the sleeper, greater rigidity for the ballast/sleeper system will be generated, and the final inertia moment will be the sum of the inertia moment of the sleeper and the ballast layer arranged inside it.

Additionally, due to the proposed shape of the railroad sleeper, embodiments are directed to a light sleeper that is easy to install and maintain, easy to be carried by two workers, and suitable for being transported by engaging one piece to another (one sleeper to another), thus resulting in many logistic advantages, particularly as compared to the conventional sleepers which have high rigidity and weight in concrete sleepers, which damage the ballast layers, which have a short useful life for sleepers of poor-quality wood, which have electric conductivity in steel sleepers, and which have reliability problems in sleepers using recycled resins.

As mentioned above, embodiments of the present disclosure are directed to high-performance railroad structures (sleepers and/or fastening blocks), produced from a polyolefin composition including, for example, polypropylene and fiberglass, wherein the fiberglass content in the composition may range from 5 to 40% by weight of the composition, and which may be advantageously manufactured by an extrusion process. In one or more embodiments, the sleepers may comprise an outer layer of polypropylene (i.e., without other major polymer species or fiberglass, but including common additives such as antioxidants, anti-UV agents, etc.) as an envelope around a layer of a composition of polypropylene and fiberglass, applied by a co-extrusion process. In one or more embodiments, the railroad structures of the present disclosure may be formed with one or more apertures or structural gaps contained therein. The inclusion of such apertures or structural gaps may be without sacrificing the mechanical properties of the components, despite being formed with less material than designs without the apertures. The presently described railroad sleeper may exhibit a high elastic modulus and performance close to that of wood, thus enabling application on railroads for transporting load and passengers.

Turning to the included figures, FIGS. 2 to 16, 23A-B, and 24 illustrate structural embodiments of railroad sleeper 1, all of them possessing a void 4, as well as being formed from the polyolefins described herein. Void 4 may enable the ballast used in the railroad network to penetrate and be compacted into the sleeper 1, thus increasing the rigidity of the sleeper/ballast assembly. Also shown in the figures is the inclusion of apertures or structural gaps 6 within the sidewalls of sleeper 1, which are discussed in further details below.

Figure 1B:
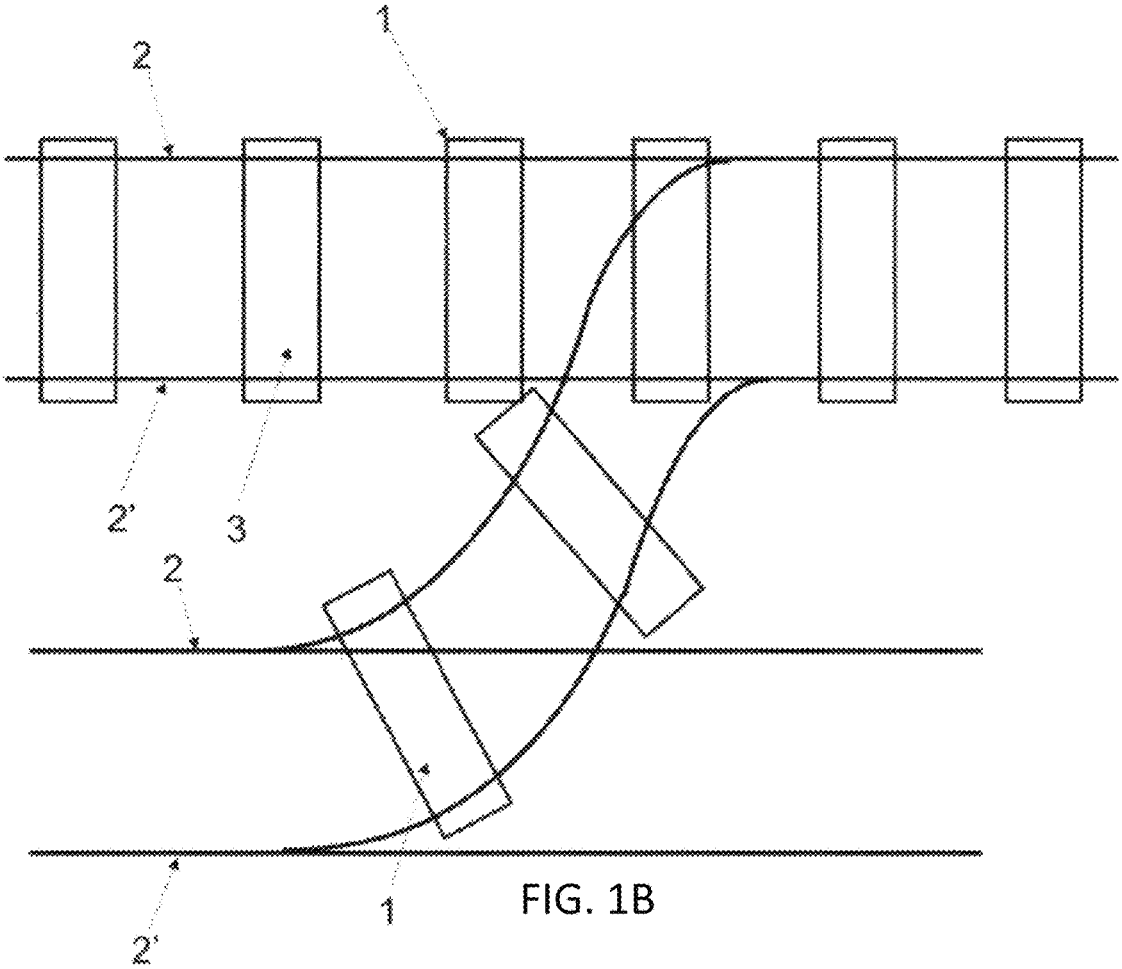
FIG. 1B is a top representation of a railroad network of multiple rails suitable for receiving the railroad structures of the present disclosure.

Referring now to FIGS. 1A and 1B, FIG. 1A is a top representation of a simple railroad network suitable for receiving the railroad structures of the present disclosure and FIG. 1B represents a railroad network of multiple rails. As shown in FIGS. 1A and 1B, the sleeper 1 may be used for fixing at least one pair of rails 2,2' of a railroad upon contact surface 3 (preferably a plane surface) of sleeper 1. It is envisioned that the sleeper 1 is suitable for use in simple railroad networks, provided with a pair of rails 2, 2', as shown in FIG. 1A, or still it may be used at point of the railroad network that comprise a number of rails 2, 2', as shown in FIG. 1B.

Figure 2:
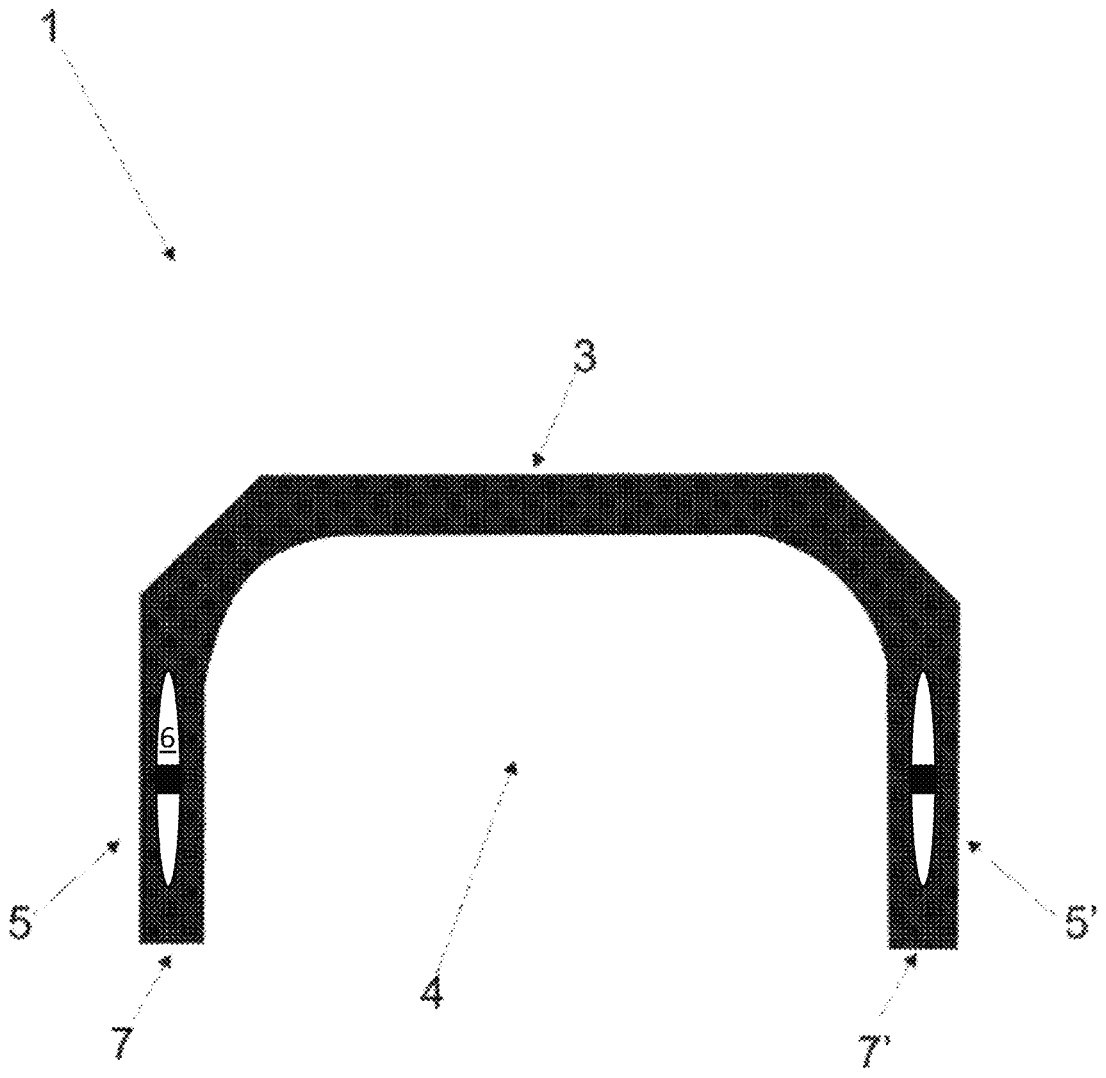
FIG. 2 is a representation of the cross section of an embodiment of a railroad sleeper.

Referring now to FIG. 2, FIG. 2 illustrates a cross-sectional view of a first structural embodiment of the railroad sleeper illustrated in FIGS. 1A-B. As shown, sleeper 1 may be formed in an inverted U-shape, which forms an upper contact surface 3, preferably plane, from which anchorage or side walls 5 and 5' extend downward, thus defining the void 4 (mentioned above) therebetween. In one or more embodiments, anchorage or side walls 5 and 5' are parallel. In other embodiments, anchorage or side walls 5 and 5' are orthogonal to the upper contact surface 3.

Upon installation, void 4 may be filled with ballast (not shown). The lower portions of the anchorage walls 5, 5', that is, the portion that supports the sleeper 1 on the soil, are called support points 7, 7', such support points 7, 7' being opposite the points of association between the contact surface 3 and the anchorage walls 5, 5'. Within anchorage walls 5, 5' (which may also be referred to as sidewalls), there may be one or more apertures 6 formed. Apertures 6 may reflect a structural gap or absence of material in the anchorage walls 5, 5' and may be numbered, sized, and of a geometric shape to maintain the mechanical properties of anchorage walls 5, 5' though forming anchorage walls 5, 5' with a reduced quantity of a propylene-based material. As shown, there is a pair of apertures 6 in each anchorage wall 5, 5', each having a semi-elliptic cylinder shape. However, other geometric shapes are envisioned such as circular, elliptical, rectangular, and the like. Further, the sizing of the shape may be selected so that the quantity of material forming anchorage walls 5, 5' may be reduced without negatively impacting the mechanical properties of the sleeper 1 (or only to an extent that is acceptable for the sleeper in use in a railway network).

Figure 3:
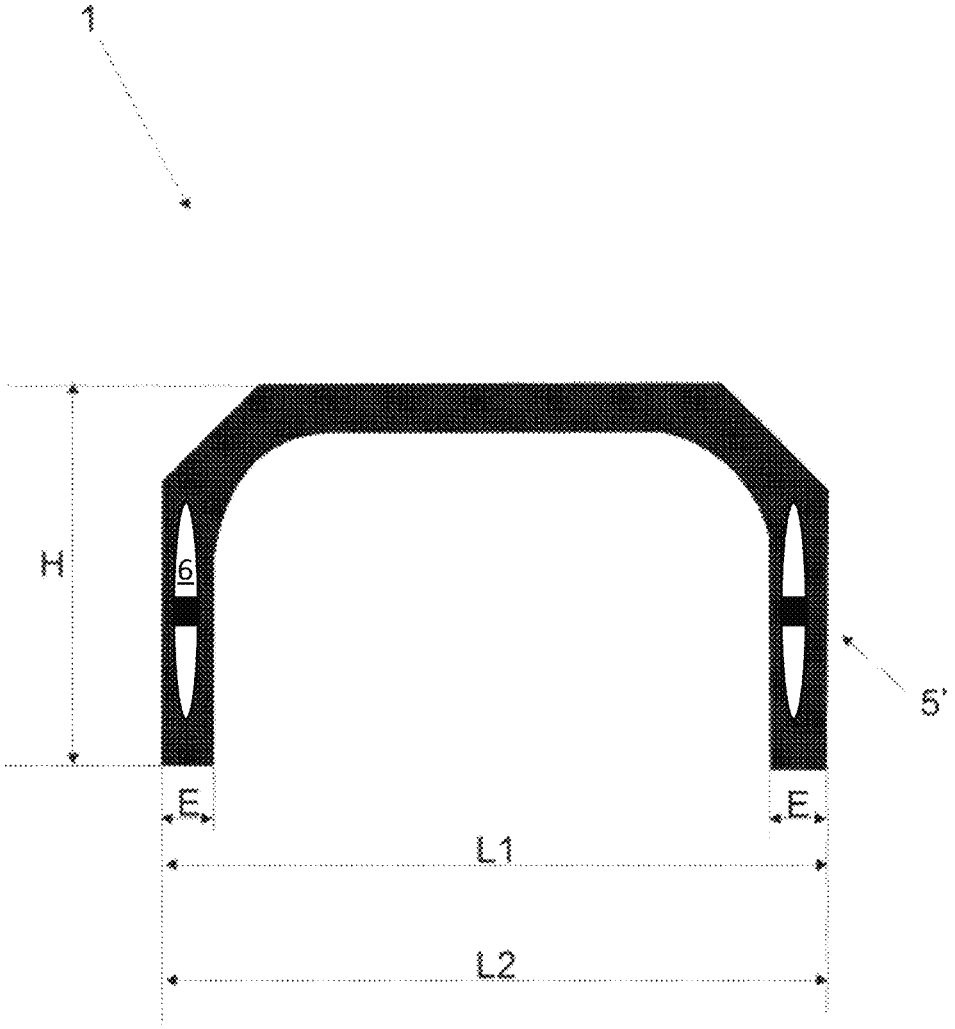
FIG. 3 is an additional representation of the cross section of an embodiment of the railroad sleeper, showing its dimensions.

With reference to FIGS. 2 and 3, the anchorage walls 5, 5' (shown as containing apertures 6) delimit a first width L1 of the railroad sleeper 1 described herein. As shown in FIG. 3, and considering a thickness E for the anchorage walls 5, 5', the first width L1 is delimited by the outermost portions (outer walls) of the anchorage walls 5,5', that is, the portions that are not facing void 4. The embodiment shown in FIGS. 2 and 3 show simple support points 7, 7', wherein the contact thickness of the sleeper 1 with the ground is thickness E of anchorage walls 5, 5'.

Figure 4A:
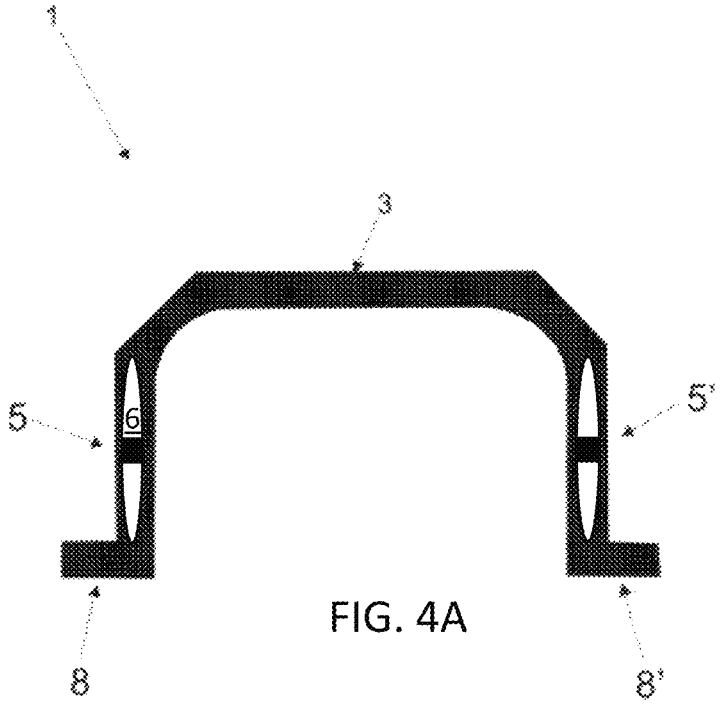
FIGS. 4A-4B is a representation of the cross section of an additional embodiment of the railroad sleeper.
Figure 4B:
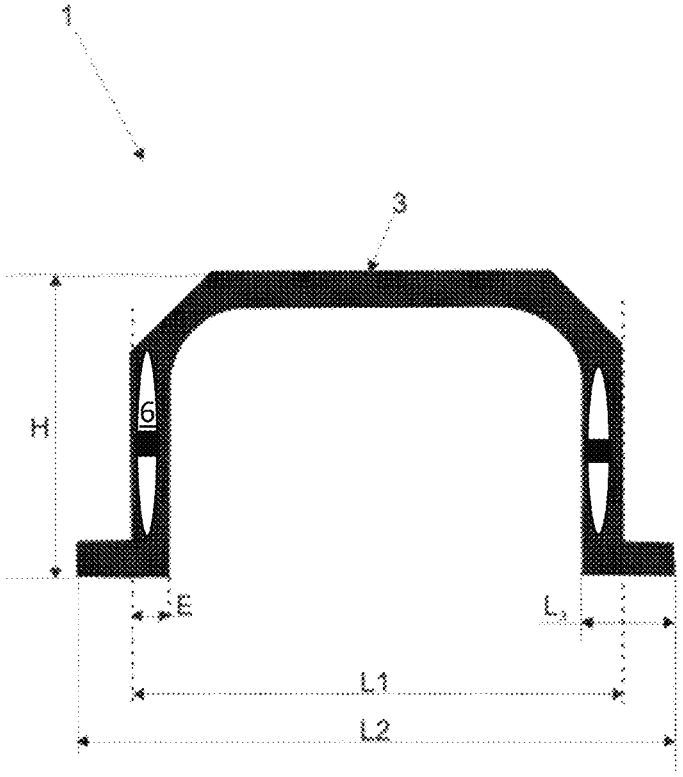

On the other hand, the embodiment shown in FIG. 4A includes laterally protruding support feet 8,8' from anchorage walls 5,5', providing a greater support than support points 7, 7'. Thus, the contact thickness of the sleeper 1 with the ground exhibits dimensions larger than the thickness E shown in FIGS. 2 and 3. The different thicknesses of the supporting surface results in a different width of sleeper 1, where L1 is defined as the distance between outer walls of anchorage walls 5,5', and L2 (shown in FIG. 4B) is defined as the distance between the widest extent of sleeper 1, including any protruding support feet 8,8'. Thus, in the embodiment in which the simple support points 7, 7' are used, the first width L1 has dimensions equal to those of the second width L2, as shown in FIG. 3. On the other hand, in the embodiment in which the laterally protruding support feet 8, 8' are used, the first width L1 is smaller than the second width L2, as shown in FIG. 4B.

Figure 5:
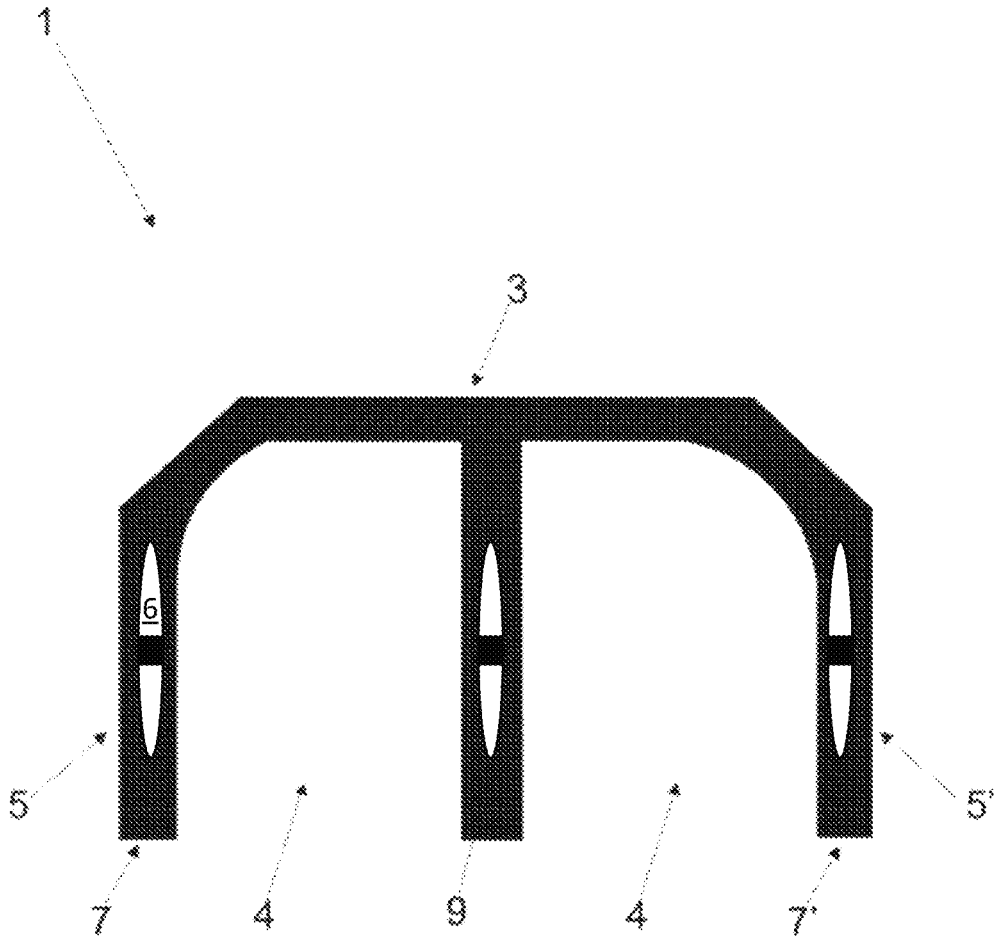
FIG. 5 is a representation of the cross section of an additional embodiment of the railroad sleeper.
Figure 6:
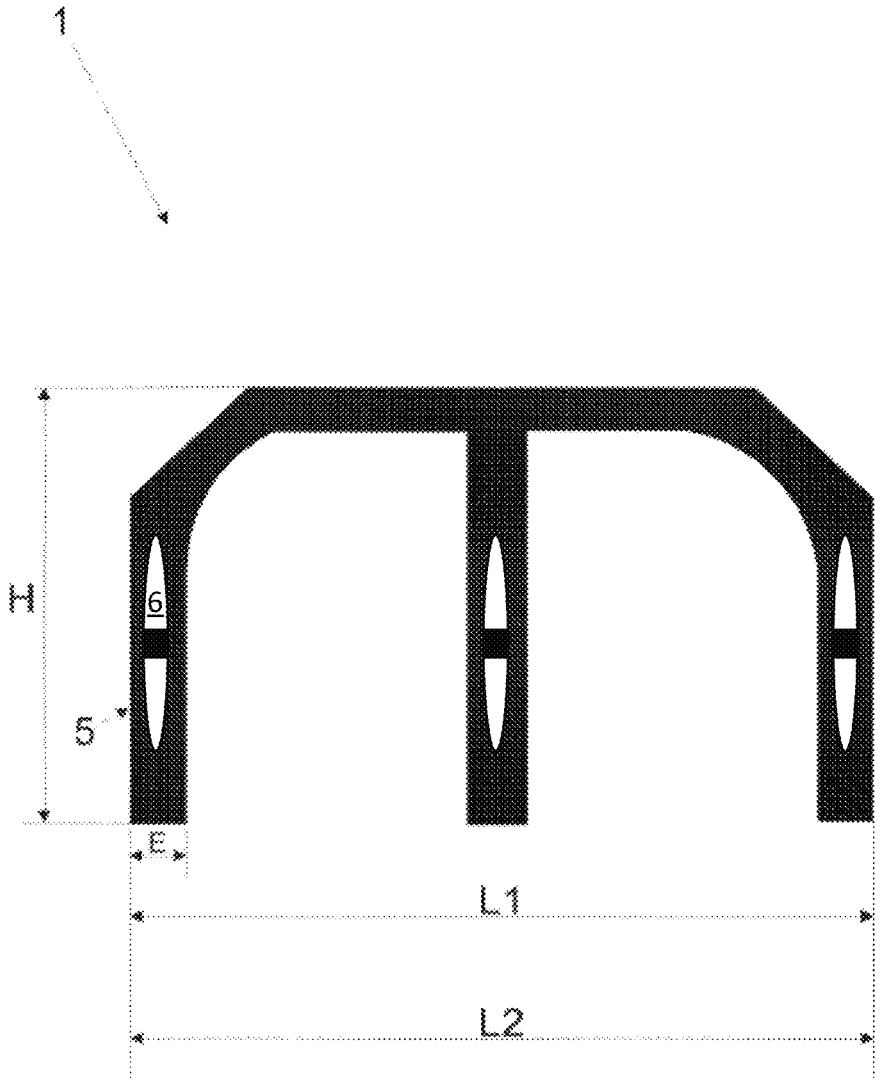
FIG. 6 is a representation of the cross section of the structural embodiment of the railroad sleeper shown in FIG. 5, illustrating its dimensions.

FIGS. 5 and 6 illustrate another embodiment for the presently disclosed sleeper 1. In this embodiment, sleeper 1 includes contact surface 3 and anchorage walls 5, 5' as described above (including apertures 6 formed therein). The embodiment shown in FIG. 5 includes of simple support points 7, 7', thus establishing equal dimensions for the first and second widths L1 and L2, respectively (as shown in FIG. 6). Also present in sleeper 1 shown in FIGS. 5 and 6 is an optional support protrusion 9 (or support leg) that extends from contact surface 3 between anchorage walls 5, 5', thereby forming two void spaces 4. Support protrusion 9 may potentiate the support of the railroad sleeper 1 disclosed herein. Further, it is also envisioned that support protrusion 9 may also include apertures 6 (such as those described above) therein.

Figure 7:
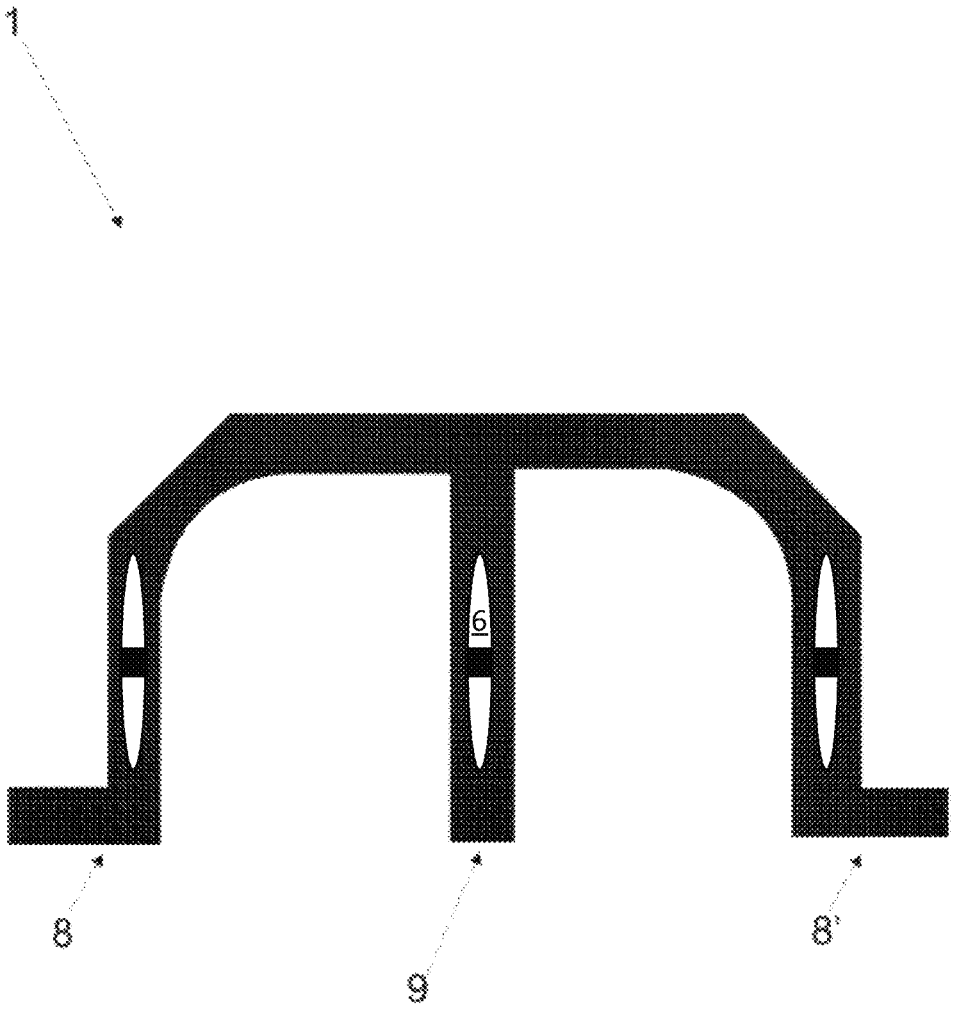
FIG. 7 is a representation of the cross section of an additional embodiment of the railroad sleeper.
Figure 8:
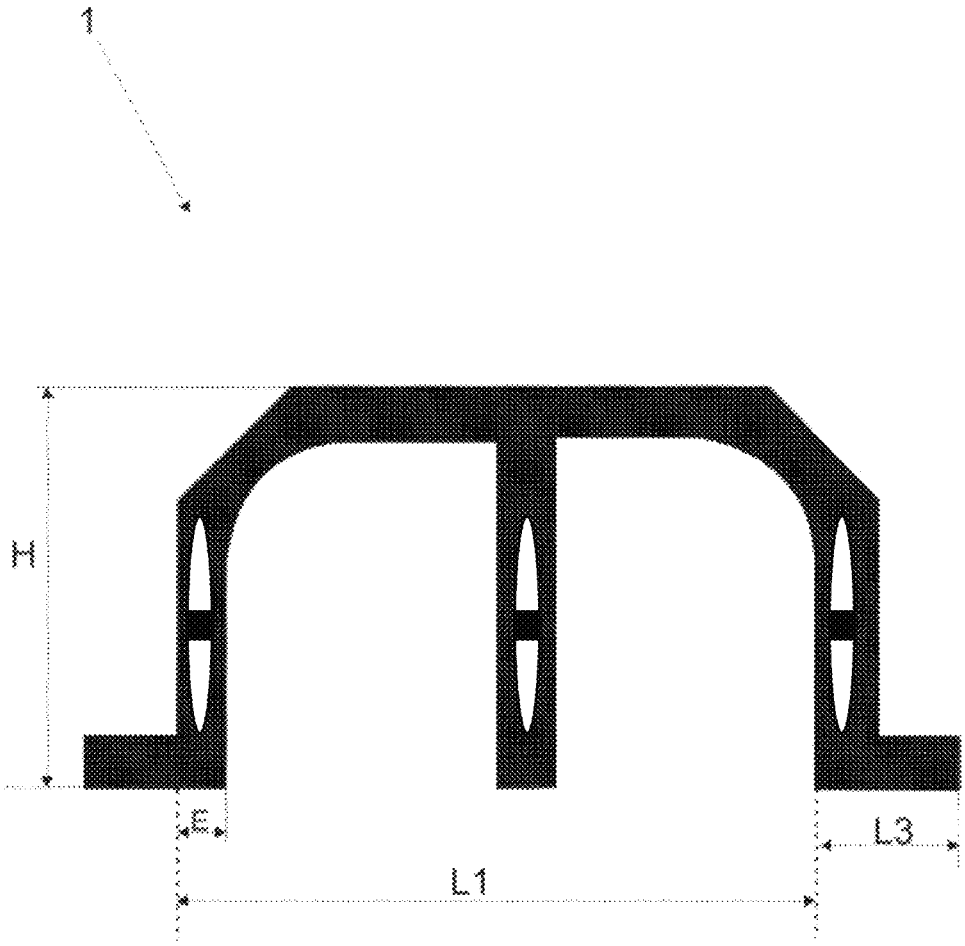
FIG. 8 is an additional representation of the cross section of the railroad sleeper shown in FIG. 7, illustrating its dimensions.

Referring now to FIG. 7, FIG. 7 illustrates another embodiment for the railroad sleeper 1 having apertures formed therein, as described above. Further, in this illustrated embodiment, sleeper 1 includes laterally protruding support feet 8, 8' described in FIGS. 4A and 4B, and a support protrusion 9 having apertures 6 formed therein, as described in FIGS. 5 and 6.

Figure 9:
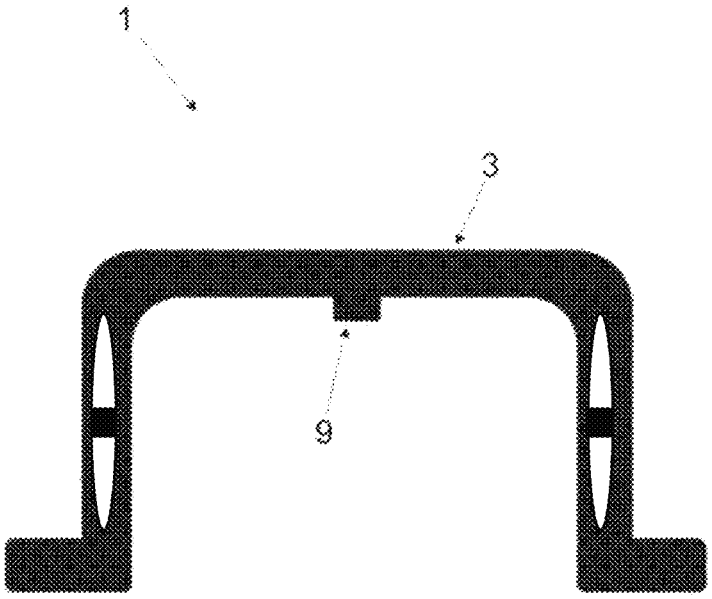
FIG. 9 is a representation of an additional embodiment of the railroad sleeper.
Figure 23A:
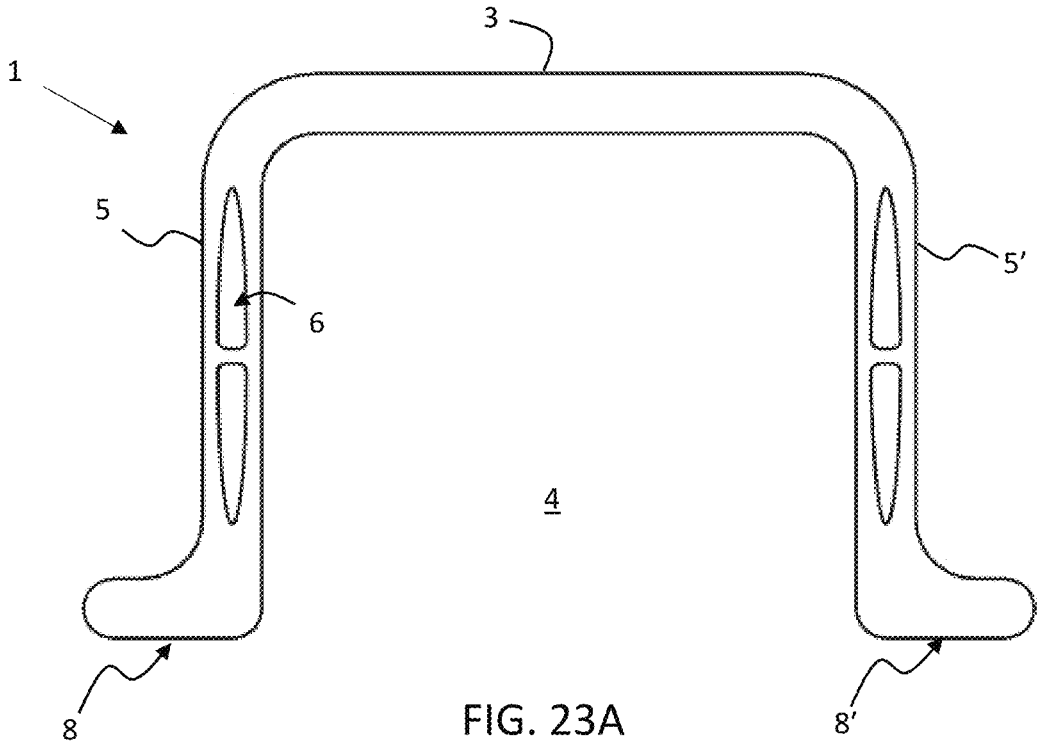
FIGS. 23A-B show a cross-section and perspective view, respectively, of an additional embodiment of the railroad sleeper.
Figure 23B:
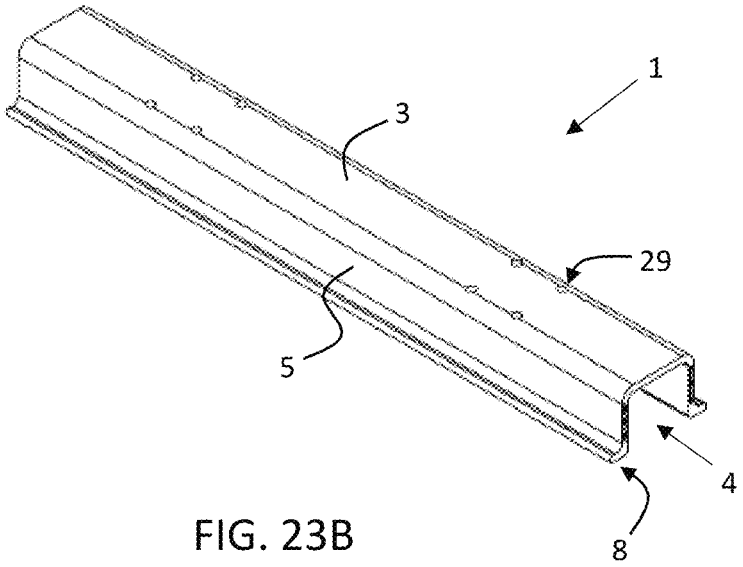

As illustrated, support protrusion 9 may protrude through the whole height of the void 4 (i.e., terminating at the same distance as anchorage walls 5, 5'), as illustrated in the embodiments shown in FIGS. 6 and 7, or, alternatively, the support protrusion 9 may protrude freely from contact surface 3 and toward void 4, as shown in FIG. 9, but less than the height of anchorage walls. While support protrusion 9 does not extend to the same extent as anchorage walls in the embodiment shown in FIG. 9, the support protrusion 9 may still provide support to the sleeper 1 through the transfer of load to ballast (not shown) filled within void 4, upon installation. Further, comparing FIG. 9 to the preceding figures, it is noted that the transition between contact surface 3 and anchorage walls 5,5' is a radiused transition in FIG. 9, whereas an angled transition is present in the above described embodiments. Further, as shown in FIGS. 23A-B, the transition between anchorage walls 5, 5' and laterally protruding support feet 8, 8' may also be radiused or it may have a sharp intersection (not shown). In particular, as shown in FIGS. 23A-B, any (and in particular embodiments, each) transition between surfaces, such as between contact surface 3 and anchorage walls 5, 5', between anchorage walls 5, 5' and laterally protruding support feet 8,8' (at outer surfaces of walls 5, 5'), in the lateral most extension of laterally protruding support feet 8,8', and between a base of laterally protruding support feet 8,8' and the inner surface of anchorage walls 5,5' (adjacent void 4) may be radiused. Further, it is also envisioned that apertures 6 may be formed with smooth transitions as well.

Figure 10:
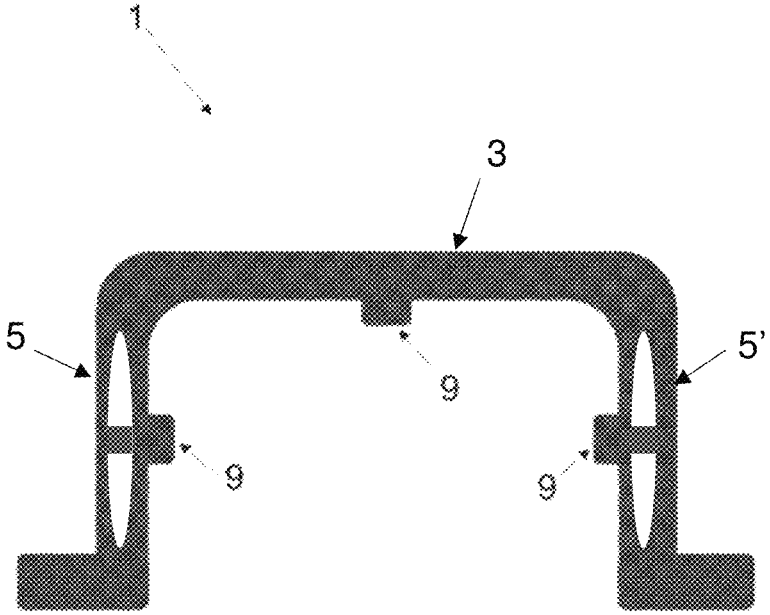
FIG. 10 is a representation of an additional embodiment of the railroad sleeper.

As illustrated in FIG. 10, in another embodiment, in addition to support protrusions 9 that protrude from contact surface 3, sleeper 1 also includes support protrusions 9 that protrudes from at least one of the anchorage walls 5, 5' laterally inward toward the void 4 of the railroad sleeper 1. Further, while FIG. 10 illustrates support protrusions 9 extending from both contact surface 3 and anchorage walls 5,5', it is envisioned that support protrusions 9 may be provided from one or the other, or both. Further, the number of support protrusions 9 shown in the figures should not be considered a limitation on the present disclosure.

Figure 11:
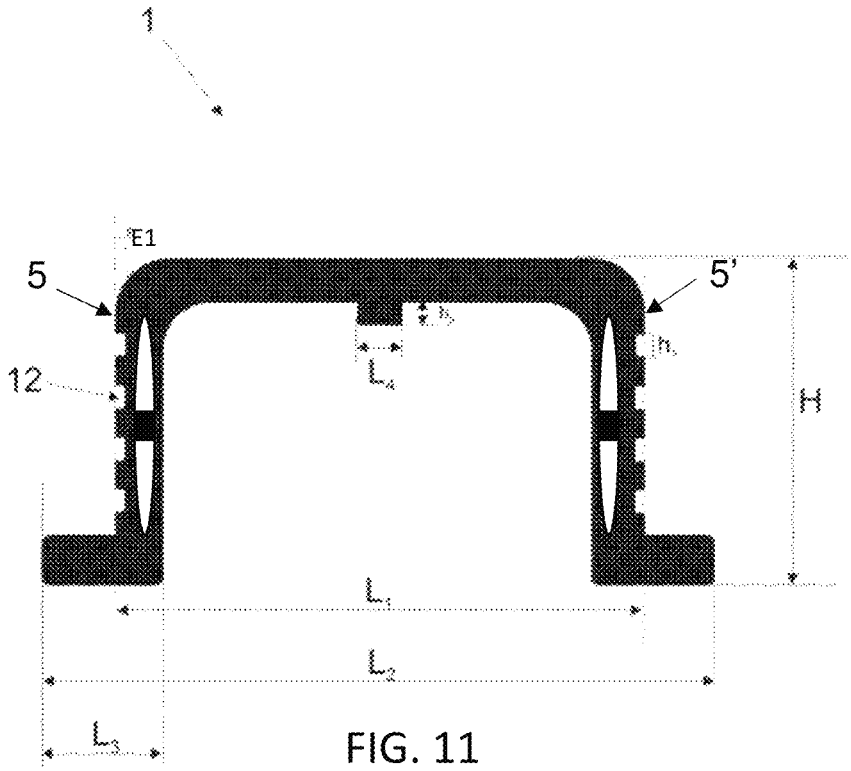
FIG. 11 is a representation of an additional embodiment of the railroad sleeper.

Referring now to FIG. 11, another embodiment of sleeper 1 is shown. As shown, sleeper 1 includes, on an outer surface of anchorage walls 5, 5', a plurality of anchorage teeth 12; however, it is also envisioned, that such teeth could be included on an inner wall surface as well or instead of the outer surface wall. As can be seen in FIG. 11, the anchorage teeth 12 are configured as recesses (channels) that may span the whole length of the sleeper 1. Generally, the anchorage teeth 12 do not interfere in the mechanical characteristics of the sleeper 1, but instead, it is considered that teeth 12 may provide greater anchorage of the sleeper 1 to the ballast (not shown), enabling the ballast to penetrate into each of the anchorage teeth 12. Additionally, the arrangement of the anchorage teeth 12 may advantageously provide a reduction of material and optimization in the manufacture of the sleeper 1.

Figure 12:
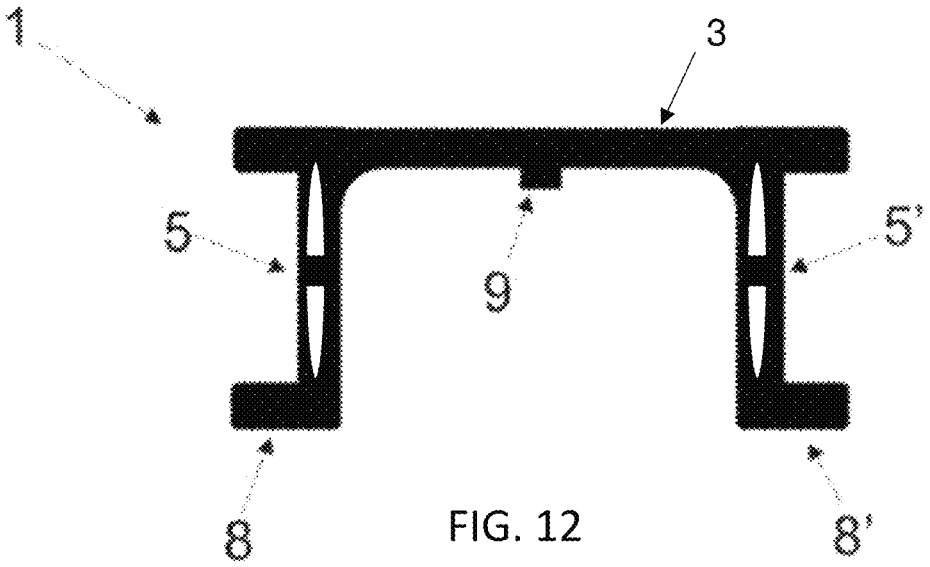
FIG. 12 is a representation of an additional embodiment of the railroad sleeper.

Referring now to FIG. 12, one or more embodiments may be directed to a railroad sleeper 1 having a contact surface 3 that protrudes beyond the anchorage walls 5, 5'. Further, it is also intended that sleeper 1 having such laterally extending contact surface 3 may also include one or more of the features shown above, including laterally extending support feet 8,8' as well as one or more support protrusions (not shown), teeth (not shown), etc.

Figure 24:
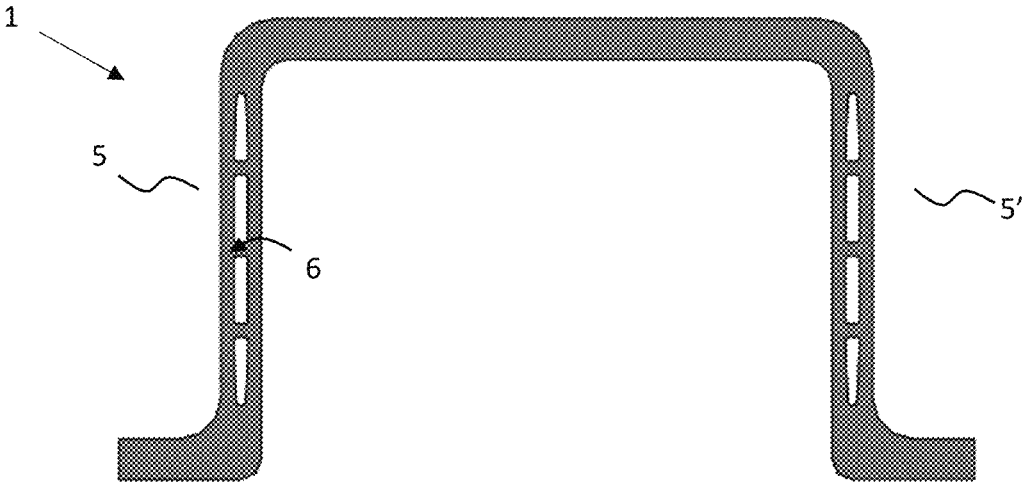
FIG. 24 shows a cross-section view of an additional embodiment of the railroad sleeper.

Referring now to FIG. 24, while above of the above-described embodiments show two apertures 6 in each anchorage wall 5, 5', one or more embodiments may be directed to a railroad sleeper 1 having more than two apertures 6 in each anchorage wall 5, 5'. In particular, as illustrated, each anchorage wall 5, 5' has four apertures 6. The uppermost and lowermost apertures 6', 6" have arched ends at the uppermost and lowermost ends thereof, respectively, whereas the middle apertures 6'" are generally rectangular with radiused corners.

Figure 13:
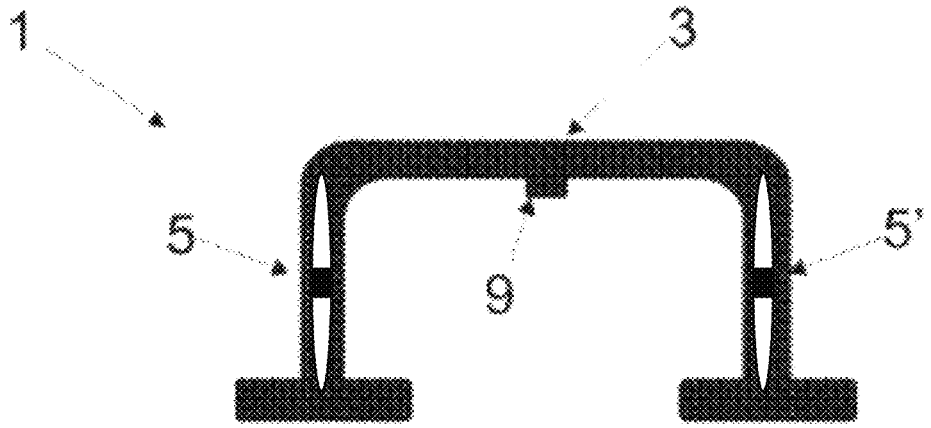
FIG. 13 is a representation of an additional embodiment of the railroad sleeper.
Figure 14:
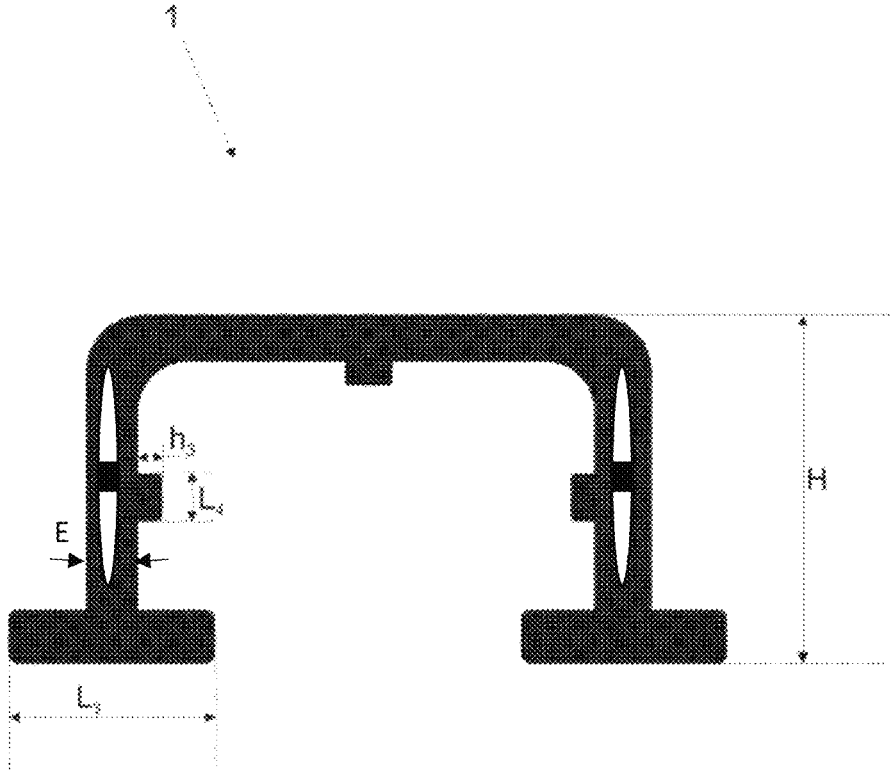
FIG. 14 is a representation of the cross section of the structural embodiment of the sleeper illustrated in FIG. 13(*c*), highlighting its dimensions.

In the embodiments in which the railroad sleeper 1 comprises laterally extending support feet 8, 8', such feet 8, 8' may protrude away from void 4 (as shown in FIG. 12), or alternatively such feet 8, 8' may protrude both away from void 4 and into it, as shown in FIG. 13. In another alternative embodiment, the feet 8, 8' might protrude only into the void 4. In this case, the second width L2 of the sleeper would assume a dimension equal to the first width L1.

In the above described embodiments (and with specific reference to FIG. 14, for convenience), the thickness E of the anchorage walls 5,5' may range from 1 to 4 centimeters. In the embodiments where the sleeper 1 comprises anchorage teeth 12, such teeth comprise a thickness E1 ranging from 0.2 to 0.5 cm (shown in FIG. 11) and a height h1 ranging from 0.5 to 2.0 cm.

For any of the embodiments described herein for the railroad sleeper 1, the first width L1 may range from 18 to 30 cm. In embodiments using laterally extended support feet 8,8' may have a second preferred width L2 ranging from 19 to 48, provided that obviously the second width L2 (extended support feet) is larger than the first width L1 (simple support points). In the embodiments in which the support feet 8, 8' protrude only into the void 4, the second width L2 will assume a value equal to the first width L1.

With regard to the width of the support feet 8, 8', referred to as third width L3 (FIGS. 4B, 8, 11 and 14), the width may range from 1.5 to 12 cm. In the case of the embodiment shown in FIG. 14, there is a preferred third width L3 ranging from 2 to 20 cm.

As to the height of the railroad sleeper 1 disclosed herein, it is referred to as a first height H which may range, for example, from 14 to 20 cm. In the embodiments that make use of the support protrusions 9, such an element protrudes from the contact surface 3 at values in the range from 0.5 to 19 cm, with the maximum being the height of the anchorage walls. The width of the anchorage protrusion 9, protruding from anchorage walls, referred to as L4, may range from 0.5 to 3.0 cm.

Figure 15:
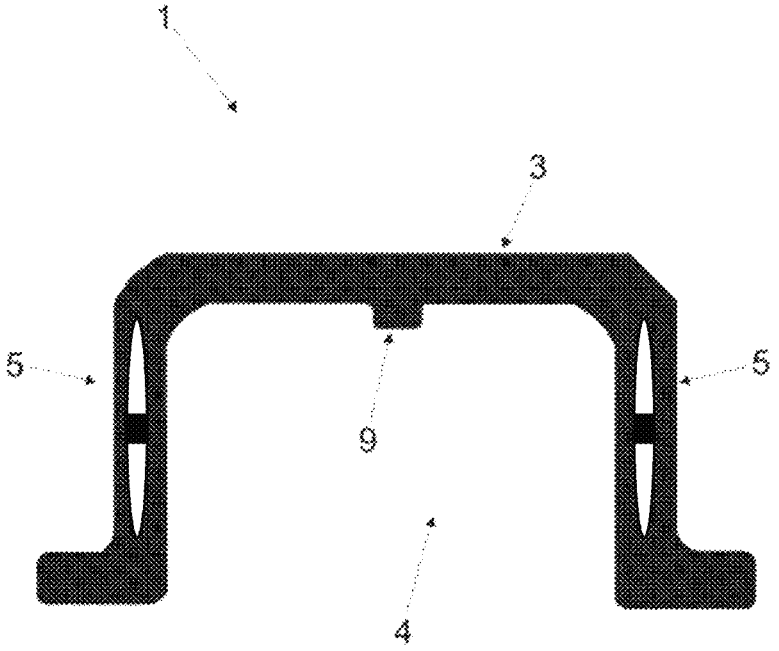
FIG. 15 is an additional embodiment of the railroad sleeper.

The transition between the anchorage walls 5, 5' and the contact surface 3 and/or the support feet 8, 8' may be carried out orthogonally or angled, as shown in previous figures, alternatively it may be carried out by segments in curvature or with a radiused transition, as in the embodiment shown in FIG. 15. Such transitions may be included with any type of transition.

In one or more embodiments, apertures 6 may have a width (measured at the widest point thereof) up to 50% of the thickness E or 40% of the thickness E, and a total length (as the sum of the lengths of all apertures) up to 80% of the height H or 70% of the height H. In particular, in one or more embodiments, apertures 6 may have a width ranging from 20 to 40% of thickness E and a total length ranging from 50 to 70% of height H.

Figure 16:
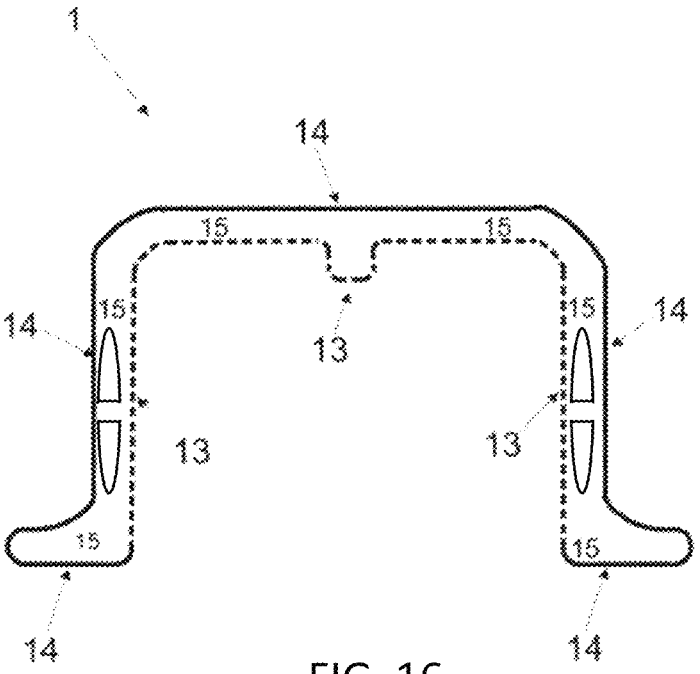
FIG. 16 is a representation of the cross section of a structural embodiment of the railroad sleeper, highlighting its inner and outer walls, and an intermediate layer.

As mentioned above, in order for the sleeper 1 to be capable of standing the stresses of its application field, it may be made of a material having a high elastic modulus (high rigidity), having also high resistance to impact, resistance to fatigue and high market availability. More specifically, in one or more embodiments, a sleeper may be formed from a singular material, however, in other embodiments, a sleeper may be a multi-layer product having an inner wall 13 (represented by dashed line) and an outer wall 14 (represented by a solid line), as shown in FIG. 16. While it is specifically intended that the entirety of sleeper 1 may be formed of a single material, other embodiments may include a multi-layered construction, where the exterior surfaces (walls 13 and 14) are formed of a first material, and the intermediate or interior portion 15 of sleeper 1 is formed from a second material. For example, the single material or the second material may include a composition comprising polypropylene and fiberglass. In one or more embodiments, the fiberglass weight content may range from 5 wt % to 40 wt % of the composition or from 33 wt % to 37 wt % of the composition in other embodiments.

In other embodiments having a multilayer structure, the inner wall 13 and the outer wall 14 may be manufactured with a composition comprising polyolefins such as polypropylene (being the same or different from the inner layer polypropylene), and the intermediate layer 15 may be manufactured from a second material. For example, polypropylene may be used in the outer surface layer and a composition comprising polypropylene and fiberglass may be used in in the intermediate layer of the sleepers.

It is noted that use of the composition of polypropylene with fiberglass as the single material or in the intermediate layer 15 is one embodiment of the present disclosure, and that in other embodiments any material or composition having a bending modulus, as determined according to the ISO 178 standard, higher than or equal to 5000 MPa might be used.

Figure 19:
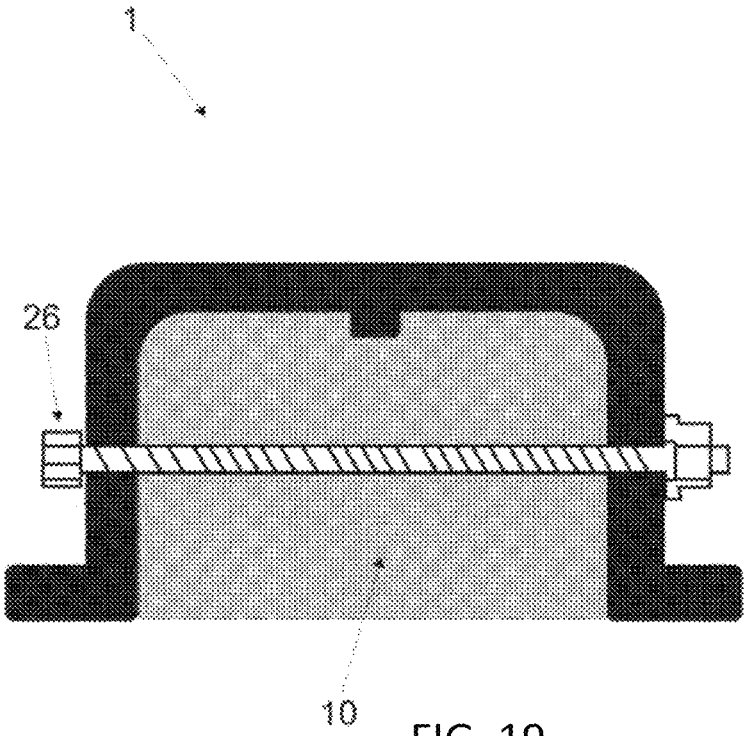
FIG. 19 is a representation of the fixation of a railroad sleeper to a fastening block by a fixation element arranged transversely on the sleeper.

Referring now to FIG. 19, for fixation of the proposed sleeper 1 to the rails 2, 2', fastening blocks 10 may be arranged in the void 4 of the sleeper 1. These blocks have the primary function of enabling the installation of the tirefonds and installation of the fixing devices that fasten the rails 2, 2' to the sleeper 1. More specifically, such blocks 10 prevent lateral movements of the railroad and may be arranged in the portion of the sleeper 1 that is below the rails 2, 2', or, in other words, in the portion of the sleeper 1 opposite the point of arrangement of the tracks on the contact surface 3.

Figure 18:
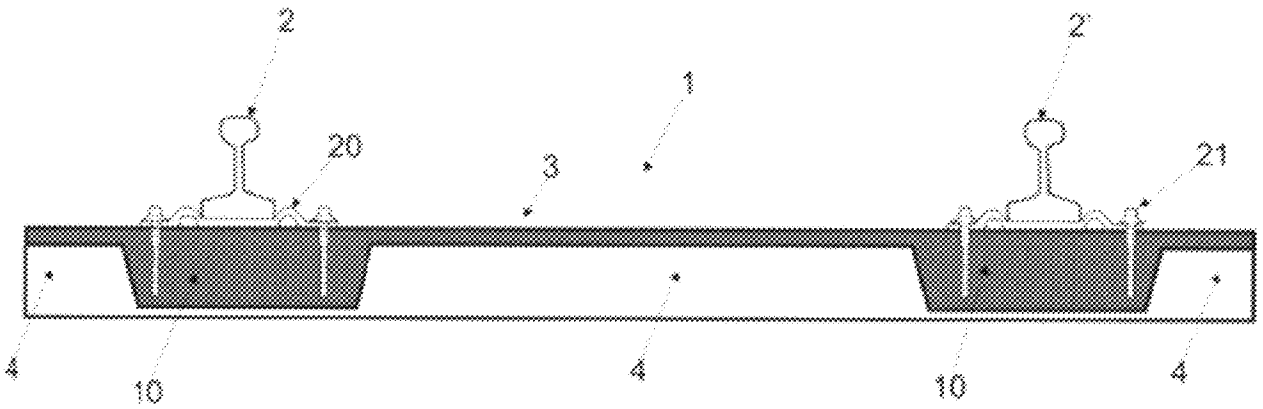
FIG. 18 is a profile representation of a railroad network having a railroad sleeper with fastening blocks.

FIG. 18 illustrates a profile view of a railroad network in which the sleeper 1 described herein is used. In this figure, each of the rails 2, 2' are fixed to the contact surface 3 of sleeper 1 by means of the support plates 20 and tirefonds 21. In the void 4 of the sleeper 1, which, when fixed to a railroad network, enables the ballast of the railroad to penetrate the void 4 and, with the compaction of the ballast in the void 4, greater rigidity of the ballast/sleeper system will be achieved.

It is further noted in FIG. 18 that the fastening blocks 10 are arranged below each of the rails 2, 2', such blocks 10 being configured as solid blocks and may be made from wood, recycled material, concrete, polyethylene, polypropylene, and still may be made from the same material used in the manufacture of the sleeper 1, a composition comprising polypropylene and fiberglass. In particular embodiments, the fixing blocks 10 are made from polyethylene. In particular embodiments, the fastening block may be produced from virgin polyethylene, biobased polyethylene such as polyethylene from the I'm Green™ family from Braskem, recycled resin, post-consumer resin, and combinations thereof. In particular embodiments, the fastening blocks are made from a high-density polyethylene.

Such fastening blocks 10 may be manufactured by different processes, such as extrusion molding, pultrusion, injection molding and machining processes that use massive blocks to obtain the final shape of the piece. Further, in one or more particular embodiments, fastening blocks, like in the sleepers described herein, may include one or more apertures 16 or structural gaps that reduce the amount of material needed to form fastening block 10 without negatively impacting the mechanical properties of fastening block 10, or with an impact on the mechanical properties that still allows the use of those blocks in the sleeper structure, as shown in FIG. 20D. In one or more embodiments, such apertures 16 may have a width of up to 50% or 40% of the width of the fastening block 10. For example, width of aperture 16 may range from 20 to 40% of the width of fastening block 10. In one or more embodiments, apertures 16 may have a height of up to 80% or 70% of the height of fastening block. For example, height of aperture 16 may range from 40 to 70% of fastening block. It is understood that smaller apertures may also be used (or a plurality of apertures) but may not offer as much of percent weight reduction as achieved with larger apertures.

For better fixation of the blocks 10 to the sleeper 1, fixing elements, preferably configured as hexagonal screws 26 might be arranged transversely to the sleeper 1, as preferably represented in FIG. 19. FIGS. 20A-F,21A-B, and 31-32 illustrate shapes proposed for the fastening blocks 10. It is understood that the any of the structural embodiments proposed for the railroad sleeper 1 may be used in combination with any of the embodiments of the fastening blocks 10.

Figure 20E:
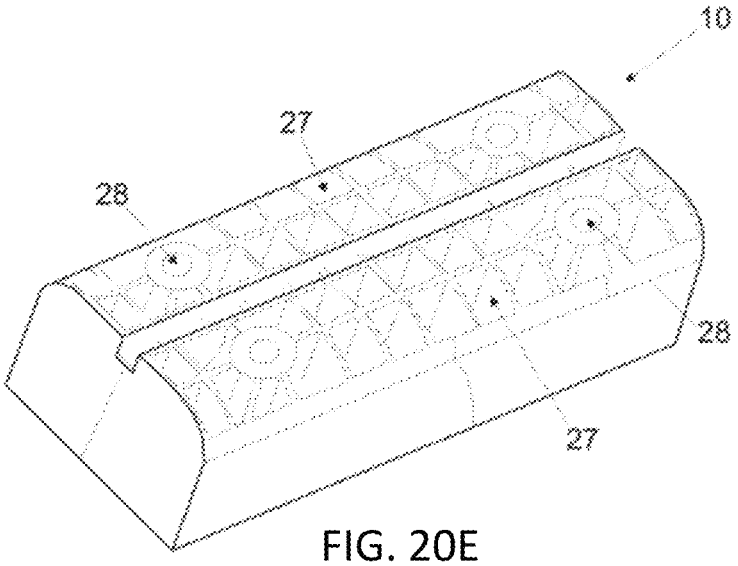
Figure 20F:
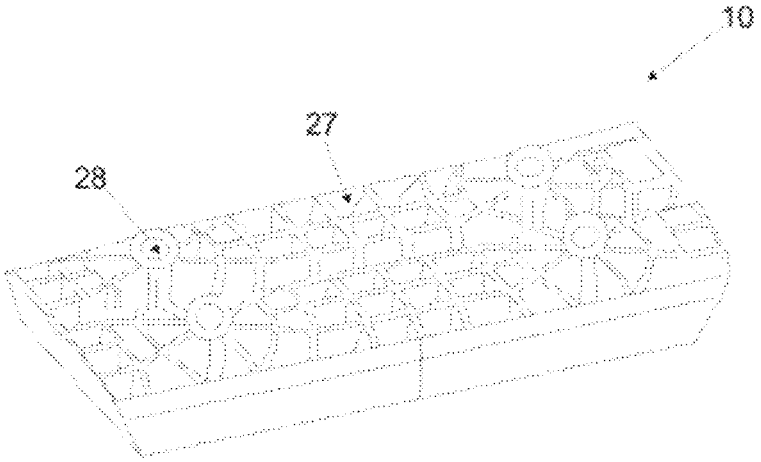
Figure 21A:
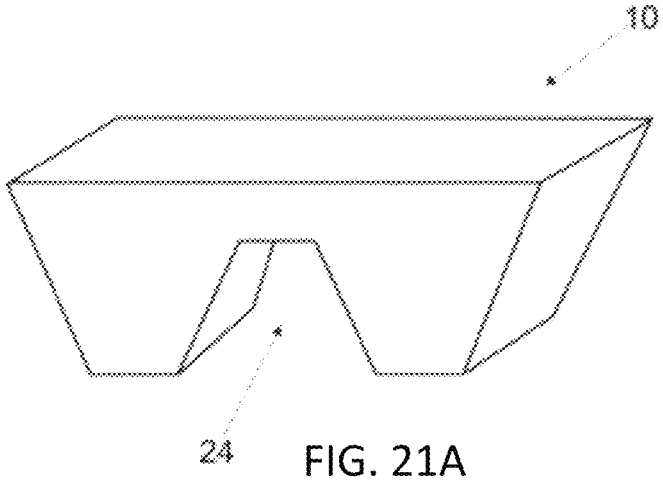
FIGS. 21A-B illustrated additional embodiments for the fastening blocks to be used in conjunction with the railroad sleeper proposed in the present invention.
Figure 21B:
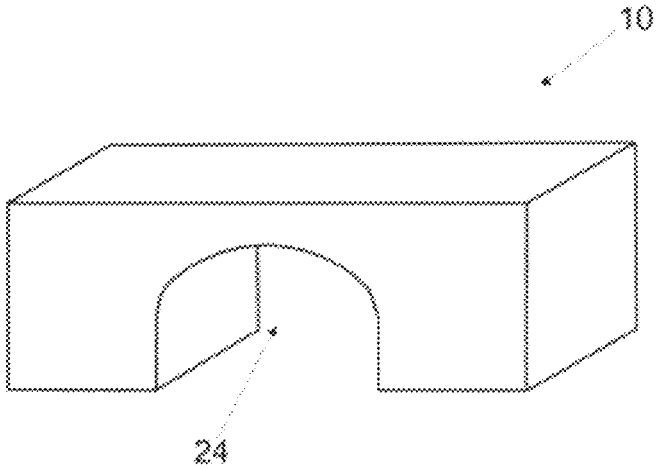

The embodiments illustrated in FIGS. 20E and 20F provide fastening blocks 10 made by injection process. It is noted that the blocks 10 illustrated in such figures comprise a number of rib structures 27 designed for supporting loads referring to the arrangement of railroad coaches.

Thus, the rib structures 27 combine resistance and lightness and establish a new possibility of arranging the fastening blocks 10. Further, blocks 10 may further comprises orifices 28 designed for arrangement of appropriate screws. It should be pointed out that the arrangement and the shape of the structures 27 should not be limited to the embodiments shown in FIGS. 20E and 20F.

Figure 32:
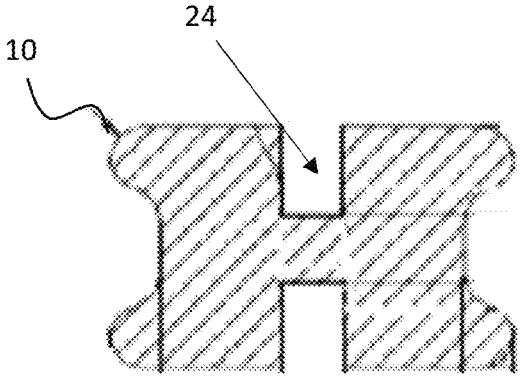

As shown in FIGS. 21A-B and 31-32, fastening blocks 10 may also include one or more void spaces 24. In the embodiments shown in FIGS. 21A-B, the void space 24 results in the fastening block taking a form similar to the inverted U-shape described with respect to the sleepers 1. In the embodiments shown in FIGS. 31-32, each fastening block 10 includes two void spaces 24, thereby resulting in the fastening blocks 10 taking an H-shape. In one or more embodiment, void spaces 24 may have a width of up to 50% or 40% of the width of the fastening block 10. An example width of void space 24 may range from 15-40% of the width of the fastening block 10. In one or more embodiments, void spaces 24 may have a total height (the sum of all heights) of up to 75% or up to 65% of the height of fastening block 10. An example total height of void space 24 may range from 50 to 70% of the height of fastening block 10. While some embodiments of fastening blocks 10 may have generally sharp edges (with a small radius), as shown in FIGS. 20A-D and 21A-B, it is also envisioned that the fastening blocks may have larger radiused edges. Further, it also envisioned that the upper and/lower surfaces of fastening blocks 10 may protrude further than the vertical surfaces of fastening blocks, as shown in FIG. 32 (and similar to the protrusions shown in the sleeper embodiment shown in FIG. 12).

In one or more embodiments, the fastening blocks 10 described in FIGS. 20A-F, 21A-B, and 31-32 may be used in combination with any of the sleepers 1 described with respect to FIGS. 2-17 and 23-24; however, it is also intended the presently described fastening blocks 10 may be used in combination with other sleepers, without apertures, such as those described in U.S. Patent Publication No. 2018/0327977, which is herein incorporated by reference in its entirety.

In one or more embodiments, any of the fastening blocks 10 discussed in the present disclosure and disclosed in FIGS. 20A-D,21A-B, and 31-32 may be made by an injection process, thus configuring a structured block (with or within the rib structures 27). In other embodiments, the fastening blocks 10 discussed in the present disclosure and disclosed in FIGS. 20A-D,21A-B, and 31-32 may be made by extrusion molding process, thus having a continuous surface, without the rib structures 27.

In one or more embodiments, as an alternative to using fastening blocks with sleepers, it is also envisioned that the sleepers 1 of the present disclosure may be fixed by means of the already existing cast-iron plates 25 and still by means of the metallic plates 22 (preferably made of steel) fixed to the existing plates (plate 25) by means of conventional fixing element 23, such as screws, press washers and nuts, which is inserted through orifices (shown in FIG. 23B as orifices 29).

Figure 22A:
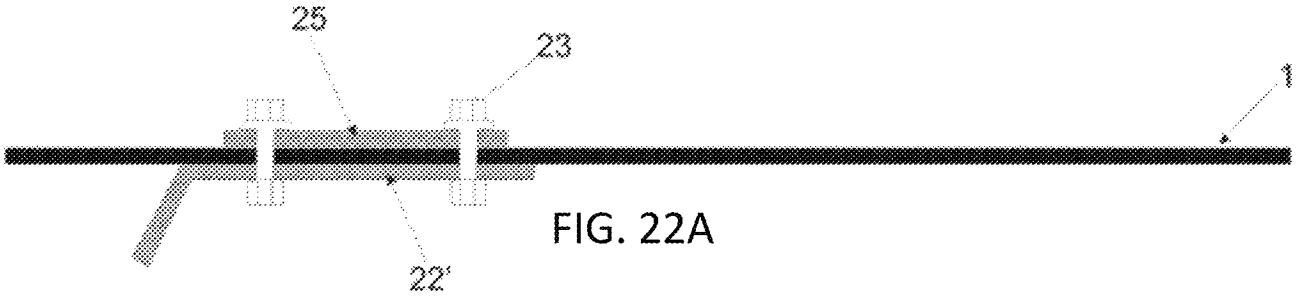
FIGS. 22A-B illustrate the fixation of the railroad sleeper proposed in the present invention by means of metallic plates.
Figure 22B:
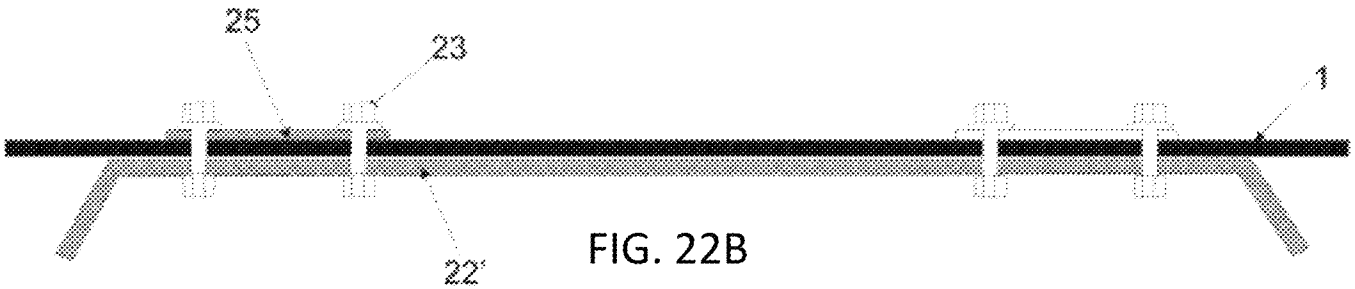

Such fastening form is illustrated in FIGS. 22A and 22B, wherein FIG. 22A shows metallic plates 22 of smaller size as compared to that represented in FIG. 22B. The embodiment shown in FIG. 22B, being arranged completely between the rails of the railroad network, ends up increasing the strength of the sleeper 1. It is further pointed out that the number of metallic plates 22 used should not be restricted to the number shown in FIGS. 22A-B.

Figure 17:
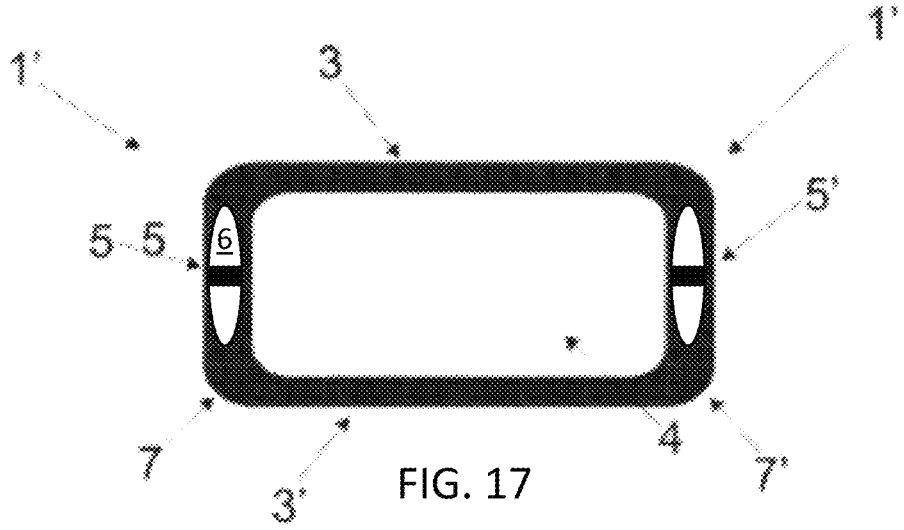
FIG. 17 is a representation of the cross section of an additional embodiment of the railroad sleeper.

Referring now to FIGS. 17, it is also envisioned that the sleeper of the present disclosure does not form an inverted U-shape. For example, as shown in FIGS. 17, a railroad sleeper 1' includes a contact surface 3 (on which rails contact) as well as a support surface 3' opposite contact surface 3 (and also extending between anchorage walls 5,5' at the base of the sleeper 1'. In such an embodiment, void 4 is actually a hollow portion of the sleeper defined by the contact surface 3, anchorage walls 5,5', and support surface 3'. It should be pointed out that the other characteristics and embodiment proposed for the railroad sleeper 1 in the embodiments disclosed herein are also valid for the embodiment of the railroad sleeper 1' shown in FIG. 17 and that comprises the support surface 3'. Further, it is also intended that anchorage walls 5, 5' in sleeper 1' may also include the apertures 6 described above.

The structural forms of the railroad sleeper 1, 1' described herein may be obtained preferably by an extrusion/co-extrusion process. Such a process is carried out by means of a conventional extruding machine, provided, for example, with a feed point, thread cannon, matrix, calibrator and velocity reducer.

Generally speaking, during the extrusion process, compaction of the composition (structure that forms the sleeper 1,1') that happens when the melted polymer passes through the die plate and within the calibrator with a homogenous cooling and vacuum by the whole profile of the piece is permitted.

The process described herein comprises an initial step of adding the composition used (preferably polypropylene with fiberglass) to the feeder of the extruding machine and then regulate the temperatures of all melting zones of the extruder and in the die plate to meet the characteristics of the material.

In embodiments using a multi-layer sleeper, concomitantly with the above step, the first polymeric material (polypropylene with fiberglass) may be added to an extruding machine, and in a co-extrusion connected before the die plate, other resins such as pure polypropylene, polypropylene with black master batch, or polypropylene with additives may be added together with the composition of polypropylene and fiberglass.

Thus, the composition of polypropylene with fiberglass may be coated with polypropylene (without fiberglass, such as pure polypropylene or polypropylene with other additives), thus establishing a structure with the arrangement of the inner 13 and outer 14 walls in polypropylene (without fiberglass) and the intermediate layer 15 in polypropylene and fiberglass. Thus a structure similar to the extrusion process known as ABA is formed, in which the first layer (layer A) consists of a determined material (in this case, polypropylene), the intermediate layer (layer B) consists of another material (in this case a composition of polypropylene with fiberglass), and the third layer consists again of the material A (polypropylene). It is also envisioned that only an inner 13 or an outer 14 layer is coextruded with the intermediate layer 15, therefore forming and AB or a BA multilayer structure.

It should be pointed out that the manufacture of the inner 13 and outer 14 walls from the same material used in making the intermediate layer 15 (in this case, polypropylene without fiberglass) is just an example embodiment. Thus, the walls 13 and 14 might be made from a material other than that used in the layer 15, as long as obviously it provides the necessary adherence to the piece. It is also envisioned that only a composition comprising polypropylene and fiberglass may be added to the extruder for embodiments using a single material structure.

Following the description of the above-mentioned steps, after melting the structure within the cannon and the screw of the extruding machine, the molten structure is extruded within the matrix, said matrix having the main function of shaping the structure to a desired shape.

Subsequently, the structure, upon coming out of the matrix, passes through calibrator provided with a water-based cooling system. Said cooling system aims at keeping the molten structure in its final shape, besides aiding in cooling the piece.

Upon coming out of the calibrator, the piece gets into a system for controlling the velocity of the extruding machine, thus limiting the flowrate of the process and enabling compaction of the structure within the calibrator, thus preventing bubbles and loss of material. Finally, the molten structure is cut into a desired size.

Depending on the desired shape for the railroad sleeper 1, 1', the calibrator of the extruder may be configured as a calibrator with or without vacuum. On calibrators without vacuum, an example length may range from 0.3 to 0.5 meters, while on a calibrator with vacuum, a length may range between 1 and 4 meters and vacuum of the cooling chamber from 0 to 0.4 bar.

It is pointed out that a calibrator without vacuum may be particularly desirable for shaping the railroad sleeper 1 containing an open void (shown in FIGS. 2-16). On the other hand, a calibrator with vacuum may be used in shaping the sleeper 1' whose void 4 is delimited by the support surface 3'.

Additionally, the following preferred parameters for the extruding machine may be used:

- temperature of the extruder preferably ranging from 220° C. to 250° C.;
- amperage of the extruder ranging from 25 to 350 A;
- pressure of the head ranging from 5 to 70 bar;
- velocity of the extruding machine (velocity of the line) ranging from 0.1 to 0.5 meters/minute; and
- rotation of the screw preferably ranging from 10 to 45 rotations per minute (rpm).

Although the process of shaping the railroad sleeper 1, 1' has been referred to as an extrusion process, one should understand that such a characteristic is just a preferred embodiment, so that other processes might be used for structural shaping of the proposes sleeper 1, such as an intrusion, injection molding or pultrusion process.

In one or more embodiments, the composition comprising polypropylene and fiberglass contains fiberglass in the range from 5 wt % to 40 wt % of the composition, and more particularly from 33 wt % to 37 wt % of the composition.

EXAMPLE

Figure 25:
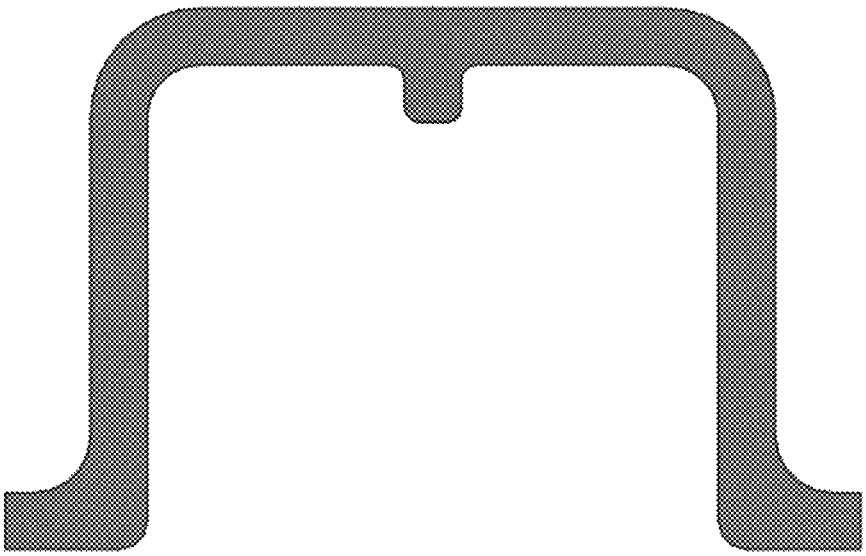
FIG. 25 shows a cross-section view of a comparative railroad sleeper.
Figure 26:
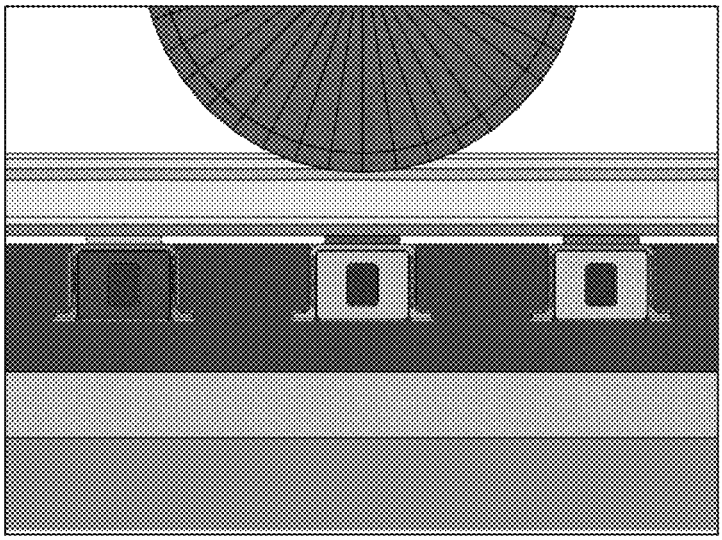
FIG. 26 shows an installation design for a sleeper and fastening block used in a simulation.
Figure 27:
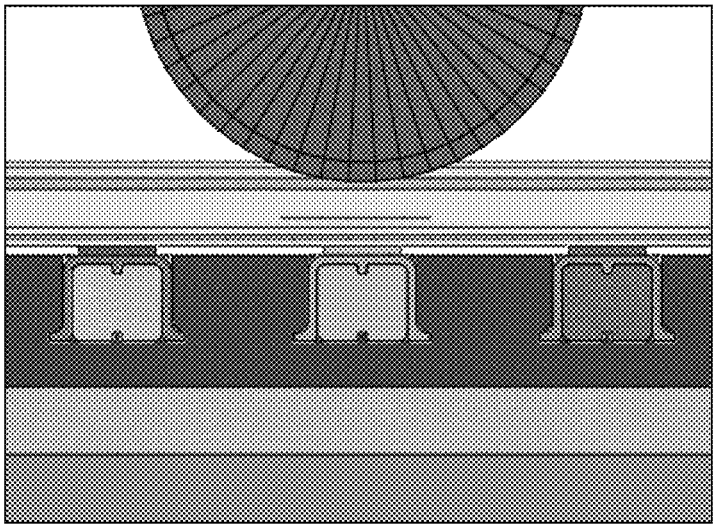
FIG. 27 shows an installation design for a comparative sleeper and fastening block used in a simulation.

A sleeper (S1) of the type shown in FIG. 24 (with apertures) was compared to a comparative sleeper (S2) of the type shown in FIG. 25 (without apertures) through a simulation using ABAQUS (a finite element analysis software available from Dassault Systemes). In the simulation, the S1 and S2 sleeper designs were combined with fastening blocks, as shown in FIGS. 26-27, respectively, ballast, and a rail. The fastening block used with the S1 design is of the type shown in FIG. 20D (contains an aperture or structural gap along its length), while the fastening block used with the S2 design is a solid block omitting such aperture. It is noted from FIGS. 24-25 that the projected areas (vertical direction) are maintained, and thus the contact area between the two designs are preserved. In particular, the S1 design had dimensions of 2.60 m, 170 mm, and 15 mm. The S2 design had dimensions of 2.8 m, 190 mm, and 20 mm. The weights of the designs are shown in Table 1 below:

| | S1 | S2 |
|---|---|---|
| Sleeper | 25.5 kg | 42.1 kg |
| Block | 12.4 kg (unit) | 15.6 kg (unit) |
| Total mass (sleeper + block × 2) | 50.3 kg | 73.3 kg |

Figure 28:
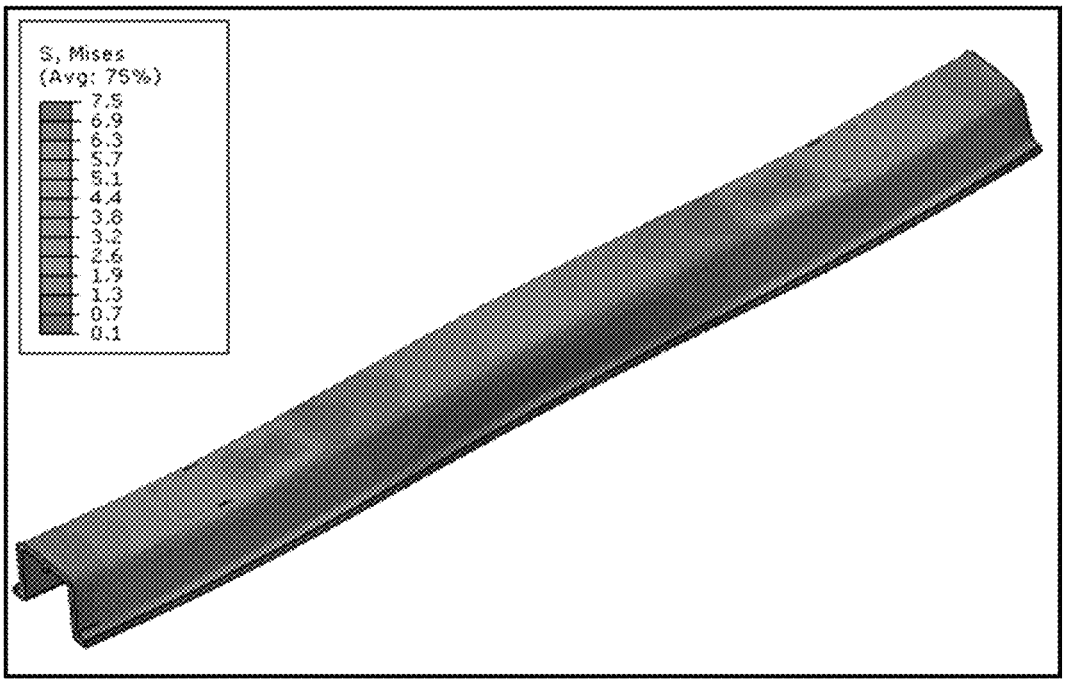
FIG. 28 shows simulation results of stresses in the installation design shown in FIG. 27.
Figure 29:
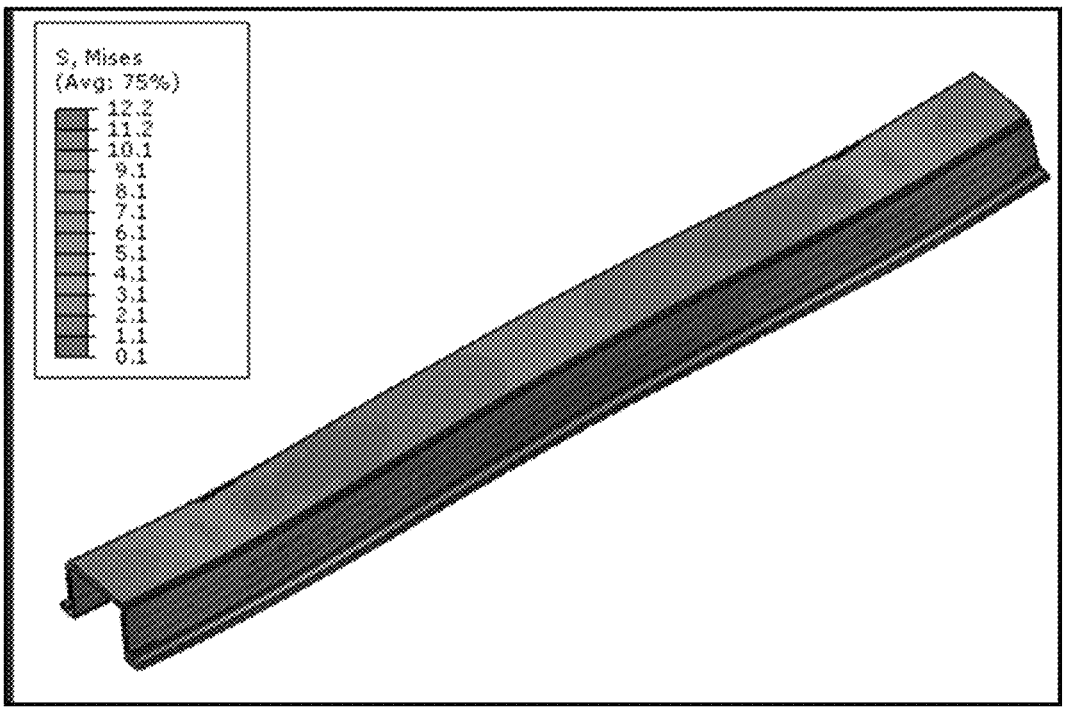
FIG. 29 shows simulation results of stresses in the installation design shown in FIG. 26.

The studies carried out for the design of S2 revealed low levels of stress in the central region of the sleeper section, as shown in FIG. 28. The predominant stress in the sleeper are due to flexion. These stresses call for the regions furthest from the neutral line and maintain lower stress levels in this region. The numerical simulation studies of the S1 model show that the stress levels (12.2 MPa) remain below the rupture stresses 70 MPa (FIG. 29).

Figure 30:
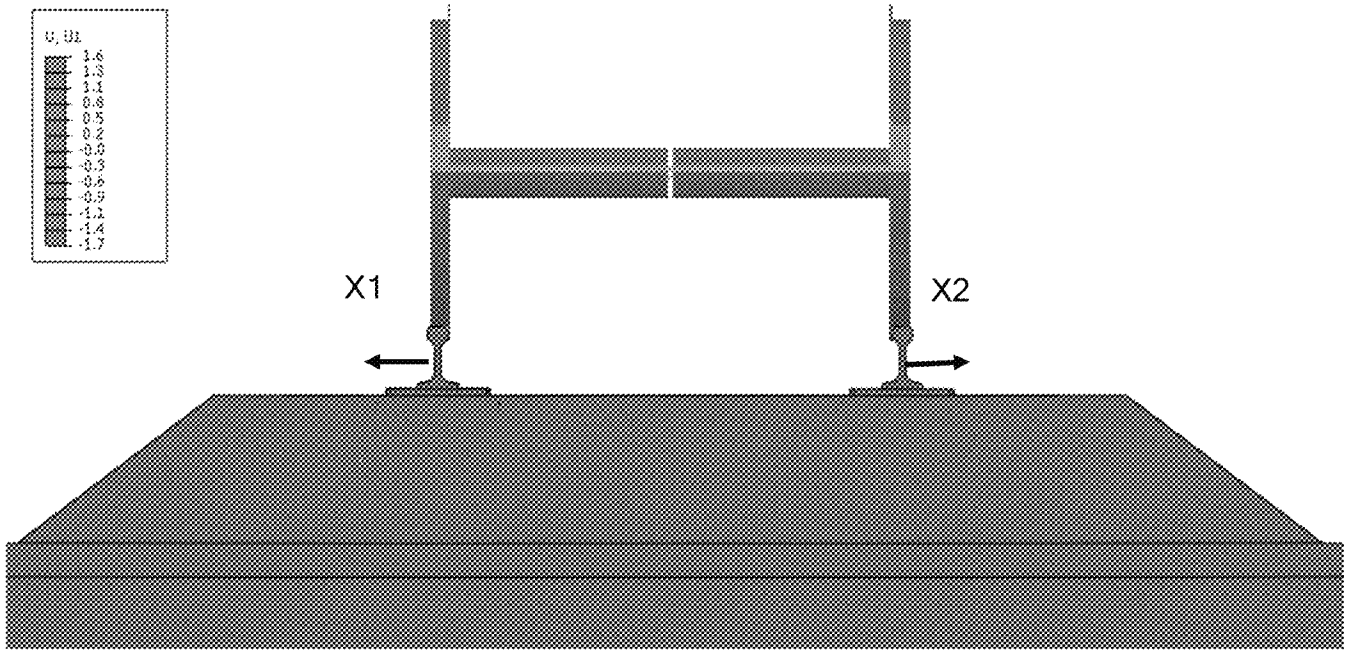
FIG. 30 shows parameters for measuring gauge.
Figure 31:
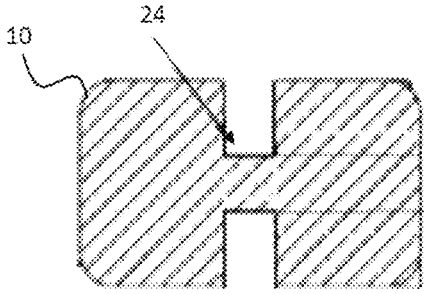
FIGS. 31-32 show embodiments of fastening blocks.

As the stiffness of S1 is less than S2, the effect of this stiffness in the railroad track gauge was tested. Applying a characteristic load (vertical and horizontal) in a regular railroad, as shown in FIG. 30, the gauge opening (X1+X2) in the S2 installation is 3.58 mm, and the gauge opening in the S1 installation is 3.94 mm. It is evidenced by the simulations that the presence of apertures, which leads to a lighter sleeper assembly, still permits its usage in railway structures as it passes in the criterion of 1% limit offset of the track gauge (16.8 mm).

Advantageously, the railroad sleepers described in the present disclosure may have one or more of the following:

- availability and reliability of the raw material to meet the large scale needs of the market;
- good electric insulator;
- high elastic modulus;
- recyclability;
- installation, fixation, and maintenance equal to those of wooden sleepers, employing the same tools and equipment;
- greater ease of transportation and maintenance, reducing logistic costs;
- inert and impermeable;
- enables the use of the fixation systems employed at present on wooden sleepers; and
- enables the production of different lengths and shapes of sleeper to meet different gages and railroad switches.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A railroad sleeper for fixation of at least one pair of rails of a railroad network, the railroad sleeper comprising:

- a contact surface having an upper surface, wherein each rail of the pair of rails is fixed thereto and spaced apart from each other, and a lower surface;
- anchorage walls extending downward from the contact surface, and having a support point at a bottom surface thereof, each anchorage wall having at least one aperture extending for a partial height of the anchorage wall along a longitudinal plane of the anchorage wall,
- wherein the at least one aperture is wholly within, and bounded by, the anchorage wall; and a void delimited by the contact lower surface and the anchorage walls.

2. The railroad sleeper of claim 1, wherein the railroad sleeper is formed from a polymeric material.

3. The railroad sleeper of claim 1, wherein the railroad sleeper is formed from a composition comprising polypropylene and fiberglass.

4. The railroad sleeper of claim 3, wherein the fiberglass is present in an amount ranging from 5 to 40 wt. % of the composition.

5. A fastening block arranged in the void of the railroad sleeper of claim 1, the fastening block comprising at least one aperture or at least one void space formed therein.

6. The fastening block of claim 5, wherein the fastening block is formed from a polymeric material.

7. The fastening block of claim 5, wherein the fastening block is formed from a composition comprising polypropylene and fiberglass.

8. The fastening block of claim 5, wherein the fastening block is formed from virgin polyethylene, biobased polyethylene, recycled resin, post-consumer resin, or combinations thereof.

9. The fastening block of claim 8, wherein the fastening block is formed from a high-density polyethylene.

10. The fastening block of claim 5, wherein the at least one void space is two void spaces, and wherein a total height of the two void spaces is 50% to 70% of a height of the fastening block.

11. The fastening block of claim 5, wherein a width of the at least one void space is 15% to 50% of a width of the fastening block.

12. A railroad structure assembly, comprising:

a railroad sleeper for fixation of at least one pair of rails of a railroad network, the railroad sleeper comprising:

a contact surface having an upper surface, wherein each rail of a pair of rails is fixed to the contact surface and spaced apart from each other, and a lower surface;

anchorage walls extending downward from the contact surface; and a void space delimited by the contact lower surface and the anchorage walls; and at least one fastening block present within the void space at a portion of the railroad sleeper corresponding to a location of a rail, wherein each anchorage wall has at least one aperture extending for a partial height of the anchorage wall along a longitudinal plane of the anchorage wall, wherein the at least one aperture is wholly within, and bounded by, the anchorage wall.

13. The railroad structure assembly of claim 12, further comprising at least one rail fixed to the contact upper surface and through the at least one fastening block.

14. The railroad structure assembly of claim 12, wherein the railroad sleeper is formed from a polymeric material.

15. The railroad structure assembly of claim 12, wherein the railroad sleeper is formed from a composition comprising polypropylene and fiberglass.

16. The railroad structure assembly of claim 15, wherein the fiberglass is present in an amount ranging from 5 to 40 wt. % of the composition.

17. The railroad structure assembly of claim 12, wherein the at least one fastening block is formed from a polymeric material.

18. The railroad structure assembly of claim 12, wherein the at least one fastening block is formed from a composition comprising polypropylene and fiberglass.

19. The railroad structure assembly of claim 12, wherein the at least one fastening block is formed from virgin polyethylene, biobased polyethylene, recycled resin, post-consumer resin, or combinations thereof.

* * * * *